US005242280A

United States Patent [19]

Fujio

[11] Patent Number: 5,242,280

[45] Date of Patent: Sep. 7, 1993

[54] ROTARY TYPE MULTI-STAGE COMPRESSOR WITH VANES BIASED BY OIL PRESSURE

[75] Inventor: Katuharu Fujio, Shiga, Japan

[73] Assignee: Matsushita Electric Industrial Co., Ltd., Osaka, Japan

[21] Appl. No.: 792,867

[22] Filed: Nov. 15, 1991

[30] Foreign Application Priority Data

Nov. 21, 1990 [JP] Japan ..... 2-319039

[51] Int. Cl.[5] ..... F04C 23/00; F04C 29/02

[52] U.S. Cl. ..... 418/11; 418/13; 418/60; 418/93; 418/96; 418/249; 418/268

[58] Field of Search ..... 418/11, 13, 60, 76, 418/82, 93, 96, 249, 268

[56] References Cited

FOREIGN PATENT DOCUMENTS 50-72205 6/1975 Japan .
62-29788 2/1987 Japan ..... 418/11
707837 4/1954 United Kingdom .
1178265 1/1970 United Kingdom .
1255825 12/1971 United Kingdom .

*Primary Examiner*—John J. Vrablik
*Attorney, Agent, or Firm*—Stevens, Davis, Miller & Mosher

[57] ABSTRACT

A multi-stage rotary type compressor is constituted in such a manner that an electric motor and a plurality of compression elements to be driven by the electric motor are disposed in a closed container and the compression elements thus-disposed are sequentially connected in series. The compressor thus-constituted is arranged in such a manner that the space in the closed container is filled with the pressure discharged from the final stage. Furthermore, lubricating oil, the pressure of which is equivalent to the level of the pressure discharged from each compression element, is introduced into a back side chamber of a vane of each compression element to urge the back side of each vane with the pressure of lubricating oil. As a result, the wear of the tip end of the vane and the input loss are prevented. Therefore, satisfactory durability and compression efficiency can be obtained.

13 Claims, 11 Drawing Sheets

ROTARY TYPE MULTI-STAGE COMPRESSOR WITH VANES BIASED BY OIL PRESSURE

BACKGROUND OF THE INVENTION

Field of the Invention

The present invention relates to a rotary type gas compressor having a multi-stage compression function, and, more particularly, to an improvement in the back pressure application to a vane for sectioning a cylinder of a low stage compression element into a suction chamber and a compression chamber and an improvement in the oil supply.

Recently, in the art of refrigerators a serviceable refrigerant compressor suitable for performing a high compression ratio operation has been studied in order to obtain a satisfactory low temperature heat source.

In particular, a variety of multi-stage rotary type compressors have been proposed in order to improve the compression efficiency by reducing the quantity of gas leaked during the compression operation by reducing the pressure difference between the compression chamber and the suction chamber.

Specifically, a rolling piston type two stage rotary compressor and the system of a two stage rotary compression refrigerating cycle constituted by connecting the rolling piston type two stage rotary compressor arranged as shown in FIGS. 11 to 13 have been proposed.

Referring to FIGS. 11 to 13, a driving electric motor 1005 is disposed in the upper portion of a closed container 1003. Furthermore, a compression mechanism comprising two stages (the upper stage comprises a low pressure compression mechanism 1007 and the lower stage comprises a high pressure compression mechanism 1009) and connected to a rotational shaft 1005*c* of a driving electric motor 1005 is disposed in the lower portion of the closed container 1003. In addition, an oil reservoir is disposed in the bottom portion. Furthermore, the back side of a vane 1007*c* (1009*c*) for sectioning each cylinder of the low pressure compression mechanism 1007 and the high pressure compression mechanism 1009 into a suction chamber and a compression chamber is connected to the space in the closed container 1003. As a result, a back pressure applied to the vane 1007*c* (1009*c*) is composed of the reaction of a spring device and the pressure in the closed container 1003.

A refrigerant gas discharged from the low pressure compression mechanism 1007 is introduced into an external gas-liquid separator 1017 via a discharge pipe 1007*e'* before it is again introduced into the closed container 1003 via a connecting pipe 1009*d'*. As a result, the driving electric motor 1005 is cooled off.

The discharged refrigerant gas again introduced into the closed container 1003 absorbs lubricating oil present in the bottom portion of the closed container 1003 when it passes through a suction pipe 1009*d* having an oil suction pipe 1023. Then, the discharged refrigerant gas which has absorbed lubricating oil is introduced into the high pressure compression mechanism 1009 so that lubricating oil is used to cool the sliding surface and seal a gap formed in the compression chambers.

The discharged refrigerant gas again compressed by the high pressure compression mechanism 1009 is introduced into an external condenser 1013 via a discharge pipe 1009*e* before it sequentially passes through a first expansion valve 1015, a gas-liquid separator 1017, a second expansion valve 1019 and an evaporator 1021. The discharged refrigerant gas is then again fed back to the low pressure compression mechanism 1007 via a suction pipe 1007*d*.

The two stage compression refrigerating cycle is constituted by the above-described refrigerating circulation so that the internal space of the closed container 1003 is maintained at an intermediate level between the pressure of the condensed refrigerant and the evaporation pressure (refer to Japanese Patent Unexamined Publication No. 50-72205).

In the structure constituted as shown in FIGS. 11 to 13, the force to be applied to the back side of the vane 1007*c* of the low pressure compression mechanism 1007 depends upon the resultant force of the pressure force of lubricating oil on which the intermediate pressure (equivalent to the pressure discharged from the low pressure compression mechanism 1007) in the closed container 1003 acts and the reaction force of the spring device. However, the body force to be applied to the back side of the vane 1009*c* of the high pressure compression mechanism 1009 depends upon only the reaction force of the spring device.

Therefore, even if the pressure in the cylinder of the high pressure compression mechanism 1009 is raised, the vane 1009*c* must be able to section the interior of the cylinder into the suction chamber and the compression chamber while preventing instantaneous jumping and retraction. In order to achieve this, the tip end of the vane 1009*c* must be always brought into contact with the surface of a rotary ring 1009*b* while overcoming the compression pressure. Therefore, there arises a necessity of using a great spring force in order to counter the compression pressure in a case where the pressure in the cylinder is raised. Therefore, in a case where the condensation pressure is produced in two stage compression in a state of stationary pressure, the tip end of the vane 1009*c* is strongly pressed against the rotary ring 1009*b* because the pressure in the cylinder of the high pressure compression mechanism 1009 is not sufficiently high. As a result, the tip end of the vane 1009*c* will be excessively worn and the frictional loss increases, causing a problem to arise in that the durability is deteriorated and the input loss increases.

In Japanese Patent Unexamined Publication No. 50-72205, a structure has been described as a conventional structure in which the closed container 1003 is filled with a high pressure refrigerant gas the pressure level of which is equivalent to the condensation pressure by introducing the gas discharged from the high pressure compression mechanism 1009 into the closed container 1003 in addition to the structure in which the inside portion of the closed container 1003 is made to be at the intermediate pressure as shown in FIGS. 11 to 13.

However, contrarily to the case shown in FIGS. 11 to 13, the above-described structure is arranged in such a manner that the back side of the vane 1007*c* of the low pressure compression mechanism 1007 is urged by a resultant force composed of the pressure force of lubricating oil on which the high pressure refrigerant gas acts and the reaction force of the spring device. As a result, the tip end of the vane 1007*c* is always pressed against to the rotor ring 1007*b* with an excessively large urging force. Therefore, similarly to the structure shown in FIGS. 11 to 13, there arises a problem in that the durability is deteriorated and the input loss increases due to the excessive wear of the tip end of the vane 1007*c* and the increase in the frictional loss.

Furthermore, since the quantity of introduction of lubricating oil present on the back side of the vane 1007*c* into the cylinder via the gap on the sliding surface increases, there arises a problem in that the input is further undesirably increased due to the oil contraction. Therefore, a two stage rotary type refrigerant compressor exhibiting durability and the compression efficiency equivalent to those of a single stage compression rotary type compressor for a low compression ratio has not been realized as yet.

SUMMARY OF THE INVENTION

Accordingly, an object of the present invention is to provide a two stage compression rotary type compressor arranged in such a manner that lubricating oil, the pressure level of which is equivalent to the discharge pressure level from the back side chambers of vanes of respective compression elements, is supplied to the back sides of the vanes of the compression elements and thereby capable of exhibiting durability and a compression efficiency which are equivalent to those realized by a single compression rotary type compressor.

Another object of the present invention is to simplify the structure of the passage for supplying lubricating oil, on which the pressure of a gas compressed in the final stage acts, to a back side chamber of a vane of each of compression elements.

Another object of the present invention is to improve the durability of the tip end of the vane and prevent the increase in the input loss by lowering the pressure in the back side chamber of the vane by reducing the quantity of lubricating oil to be supplied to the vane back side chamber to weaken the urging force acting on the back side of the vane at a high speed operation of the compressor in which time for gas compression in the cylinder is shortened and the quantity of gas leakage per sucked capacity during the compression operation therefore decreases.

Another object of the present invention is to prevent deterioration in the compression efficiency by preventing wear of the end surface of the vane by forcibly supplying lubricating oil to the sliding surfaces between the end surface of the vane and an intermediate plate and by preventing the counterflow of a compressed gas from the cylinder into the suction chamber via the above-described gap of the sliding surfaces between the end surface of the vane and the intermediate plate.

Another object of the present invention is to improve the durability of the vane sliding surface and the compression efficiency by sufficiently supplying lubricating oil and sealing the gap on the sliding surface of the vane by supplying lubricating oil, which has been supplied to the back side chamber of the vane, over a wide area of the sliding surface of the vane.

Another object of the present invention is to improve the performance and the durability of a compressor by easily securing the oil passage having a throttle portion in which an excellent accuracy must be obtained and thereby stably supplying lubricating oil to the vane back side chamber.

Another object of the present invention is to improve the compression efficiency of a high stage compression element, eliminate noises and improve the durability of a sliding surface of a high stage compression element by introducing, together with a discharged gas, lubricating oil supplied to a back side chamber of a vane of the low stage compression element into the high stage side cylinder via a low stage discharge chamber.

Another object of the present invention is to improve the durability of the vane sliding surface and to prevent the increase of the input loss by always securing lubricating oil supplied to the back side chamber of the vane and by preventing an excessive compression of lubricating oil by the pumping effect at the time of the retracting operation of the vane.

Another object of the present invention to improve the durability of the vane at the early stage of the starting operation of the compressor by supplying lubricating oil present in an oil reservoir of a discharge chamber of a low stage compression element into the suction chamber in the cylinder via the vane back side chamber and the gap on the vane sliding portion to compensate the pressure difference in, for example, an early stage of the cold starting of the compressor at which the pressure in the closed container and the temperature of lubricating oil have not been raised to sufficiently high levels.

Another object of the present invention is to prevent an excessive deterioration of the compression efficiency and the durability of the vane sliding surface by preventing diffusion of lubricating oil present in the oil reservoir in the bottom portion of the low stage discharge chamber due to the flow of the discharged gas and by preventing the counterflow of the discharged gas into the cylinder via the back side chamber of the vane.

In order to achieve the above-described object, according to one aspect of the present invention, a rotary type multi-stage compressor is arranged in such a manner that a multi-stage compression mechanism is constituted in which a plurality of compression elements are sequentially connected to one another in series. Furthermore, lubricating oil, on which the discharge pressure acts, is introduced into the back side chamber of a vane of the final stage compression element of vanes each of which sections the inside portion of each cylinder into a suction chamber and a compression chamber when it advances and retracts (move forward/rearward) in each cylinder of the compression element. In addition, an oil supply passage for introducing lubricating oil into the back side of each vane of each of the other compression elements except for the final stage compression element after the pressure of lubricating oil has been lowered to the level of the pressure discharged from each of the compression element is formed via the back side chamber of each vane. Thus, the back side of each vane is applied with the pressure of the above-described lubricating oil.

According to another aspect of the present invention, lubricating oil, on which the pressure of gas discharged from the final stage acts, is accumulated in a closed container which accommodates a plurality of compression elements and an electronic motor for driving a plurality of the compression elements and into which a compressed gas is discharged from the final stage compression element.

According to another aspect of the present invention, an opening portion of the oil supply passage having a throttle portion in the back side chamber is positioned in the slide surface of the vane to be intermittently opened/closed when the vane performs the reciprocating motion.

According to another aspect of the present invention, an oil supply passages passing through an intermediate plate is provided, the intermediate plate establishing a connection between cylinder members of adjacent compression elements. Furthermore, the oil supply passage is opened in the sliding surface of the intermediate plate which slides on the surface of the vane.

According to another aspect of the present invention, the oil supply passage having the throttle portion is opened in the upper portion of the back side chamber of the vane.

According to another aspect of the present invention, the oil supply passage having the throttle portion is formed in the junction surface between the intermediate plate for establishing the connection between the cylinders of the adjacent compression elements and the cylinder member.

According to another aspect of the present invention, a two stage compression mechanism composed of a low stage compression element and a high stage compression element is constituted. Furthermore, an oil supply passage is constituted in such a manner that a discharge chamber of a low stage compression element is disposed in the lower stream of the back side chamber of the vane of the low stage compression element.

According to another aspect of the present invention, an opening of a connection passage from the discharge chamber of a low stage compression element in the back side chamber of the vane is formed in the upper portion of the back side chamber.

According to another aspect of the present invention, the position of an opening of the lower stream of the vane back side chamber in the discharge chamber is formed in the bottom portion of the oil reservoir of the discharge chamber.

According to another aspect of the present invention, a partition plate is disposed in the upper portion of the oil reservoir in the bottom portion of the discharge chamber and a small-diameter passage is provided in the bottom portion of the partition plate, the small-diameter passage serving to establish a connection between the upper space in the discharge chamber and the oil reservoir.

According to the present invention, there is provided a rolling piston rotary type or slide vane rotary type multi-stage gas compressor arranged in such a manner that a multi-stage compression mechanism is constituted by sequentially connecting a plurality of compression elements in series. Furthermore, an oil supply passage is formed to pass the back side chamber of each vane, the oil supply passage causing lubricating oil, on which discharge pressure acts on, to be introduced into the back side chamber of a vane of the final stage compression elements of vanes for sectioning cylinders of the compression elements into the suction chamber and the compression chamber when the vanes advance and retract (move forward/rearward) in the cylinders of the compression elements. In addition, lubricating oil is introduced into the back side of each vane of the compression element except for the final stage compression element after its pressure has been lowered to a level of the discharge from each compression element. The back side of each vane is applied with the pressure of lubricating oil. As a result, lubricating oil, on which discharge pressure from the final stage acts, is caused to act on the back side of the vane of the compression element of the final stage. In addition, the back sides of vanes of the compression elements of the lower stages are applied with lubricating oil the pressure of each of which is equivalent to the pressure of the discharge chambers of the lower stages. Therefore, the back side of each vane of each compression element can be supplied with urging force which follows the pressure in the cylinder of each compression element. Therefore, the tip end of each vane can be protected from an excessive contact pressure or cannot suffer from insufficient contact pressure. Therefore, contact pressure of a proper level for sectioning the inside portion of the cylinder into the suction chamber and the compression chamber. As a result, the abnormal abrasion of the tip end of each vane and the gas leakage which can be taken place during the compression operation can be prevented. Furthermore, the input loss due to the friction can be prevented.

Furthermore, since the jumping phenomenon of the vane can be prevented, generation of impact noise of the vane can be prevented. Therefore, the durability can be improved, the noise can be eliminated and vibrations can be prevented.

According to the present invention, a rolling piston rotary type or slide vane rotary type multi-stage gas compressor is constituted in such a manner that a multi-stage compression mechanism is constituted by disposing an electric motor and a plurality of compression elements to be driven by the electric motor in a closed container and a plurality of the compression elements are sequentially connected to one another in series. Furthermore, the inside space of the closed container is filled with pressure discharged from the final stage compression element. In addition, each oil supply passage is formed to pass the back side chamber of each vane, the oil supply passage causing lubricating oil, on which discharge pressure acts, to be introduced into the back side chamber of the vane of the compression element of the final stage of the vanes for sectioning the inside portion of each of the cylinders into the suction chamber and the compression chamber when the vane advances/retracts (moves forward/rearward) in each cylinder of the compression element. In addition, lubricating oil is introduced into the back side of each vane of the compression element except for the final stage compression element after the pressure of lubricating has been reduced to a level which is equivalent to the discharge pressure from each compression element. The back side of each vane is applied with the pressure of the above-described lubricating oil. As a result, lubricating oil contained in the discharged gas from the final stage is separated and accumulated in the sealed container while simplifying the structure. Therefore, the supply of oil to the vane back side chamber of each compression element can be simplified.

According to the present invention, there is provided a rolling piston rotary type or slide vane rotary type multi-stage gas compressor arranged in such a manner that a multi-stage compression mechanism is constituted by sequentially connecting a plurality of compression elements in series. Furthermore, an oil supply passage is formed to pass the back side chamber of each vane, the oil supply passage causing lubricating oil, on which discharge pressure acts on, to be introduced into the back side chamber of a vane of the final stage compression elements of vanes for sectioning cylinders of the compression elements into the suction chamber and the compression chamber when the vanes advance and retract (move forward/rearward) in the cylinders of the compression elements. In addition, lubricating oil is introduced into the back side of each vane of the compression element except for the final stage compression element after its pressure has been lowered to a level of the discharge from each compression element. The back side of each vane is applied with the pressure of lubricating oil. Furthermore, an opening portion of the oil supply passage having a throttle portion in the back side chamber is positioned in the sliding surface of the vane so as to be intermittently opened/closed by the reciprocating motion of the vane. Therefore, lubricating oil present in the oil reservoir on which the discharge pressure from the final stage compression element acts, is intermittently stopped at the introduction portion into the back side chamber when it is supplied to the back side chamber of each vane of the lower stage compression elements via the oil supply passage having the throttle portion to compensate the pressure difference. As a result, resistance generated at the time of introducing lubricating is increased in proportion to the operation speed of the compressor. Therefore, at the time of the high speed operation in which the gas compression time in the cylinder is shortened and thereby the leaked gas quantity per sucked capacity during the compression operation, the quantity of oil supplied to the back side chamber of the vane is reduced so that the pressure in the back side chamber of the vane can be reduced. As a result, the pressure applied to the back side of the vane for sectioning the inside portion of the cylinder into the suction chamber and the discharge chamber can be weakened to prevent the wear of the tip end of the vane and the outer surface of the piston of the lower stage. Therefore, the durability can be improved and the enlargement of the gap in the compression chamber can be prevented. Therefore, the leakage of the gas during the compression operation can be reduced so that the increase in the input can be prevented and the compression efficiency can be improved.

According to the present invention, there is provided a rolling piston rotary type or slide vane rotary type multi-stage gas compressor arranged in such a manner that a multi-stage compression mechanism is constituted by sequentially connecting a plurality of compression elements in series. Furthermore, an oil supply passage is formed to pass the back side chamber of each vane, the oil supply passage causing lubricating oil, on which discharge pressure acts on, to be introduced in the back side chamber of a vane of the final stage compression elements of vanes for sectioning cylinders of the compression elements into the suction chamber and the compression chamber when the vanes advance and retract (move forward/rearward) in the cylinders of the compression elements. In addition, lubricating oil is introduced into the back side of each vane of the compression element except for the final stage compression element after its pressure has been lowered to a level of the discharge from each compression element. The back side of each vane is applied with the pressure of lubricating oil. Furthermore, an oil supply passages which passes through an intermediate plate which establishes a connection between cylinder members of adjacent compression elements is provided. Furthermore, the oil supply passage is opened in the sliding surface of the intermediate plate which slides on the surface of the vane. As a result, lubricating oil in the closed container can be forcibly supplied to the sliding surface between the end surface of the vane and the intermediate plate via the oil supply passage. Therefore, the above-described sliding surface can be lubricated to reduce the wear and as well as the gap in the sliding surface can be sealed with oil films. As a result, an excessive introduction of lubricating oil present in the back side chamber of the vane into the cylinder through the portion between the sliding surfaces at the end surface of the vane can be prevented. Therefore, undesirable increase in the input due to the contraction of oil can be prevented. Furthermore, the leakage of the compressed gas in the cylinder into the suction chamber via the gap between the sliding surfaces of the end surface of the vane and that of the intermediate plate can be prevented so that the deterioration in the compression efficiency is prevented.

According to the present invention, there is provided a rolling piston rotary type or slide vane rotary type multi-stage gas compressor arranged in such a manner that a multi-stage compression mechanism is constituted by sequentially connecting a plurality of compression elements in series. Furthermore, an oil supply passage is formed to pass the back side chamber of each vane, the oil supply passage causing lubricating oil, on which discharge pressure acts on, to be introduced into the back side chamber of a vane of the final stage compression elements of vanes for sectioning cylinders of the compression elements into the suction chamber and the compression chamber when the vanes advance and retract (move forward/rearward) in the cylinders of the compression elements. In addition, lubricating oil is introduced into the back side of each vane of the compression element except for the final stage compression element after its pressure has been lowered to a level of the discharge from each compression element. The back side of each vane is applied with the pressure of lubricating oil. Furthermore, the oil supply passage having the throttle portion is opened in the upper portion of the back side chamber of the vane. As a result, lubricating oil present in the closed container can be supplied from the upper portion of the back side chamber of the vane of the low stage compression element via the oil supply passage having the throttle portion. As a result, even if the quantity of oil supplied is insufficient, it can be sequentially supply to the sliding surface of the vane during lubricating oil drops from the upper portion of the back side chamber to the lower portion of the same. Therefore, it can be effectively used to lubricate the sliding surface and to seal the gap in the sliding surface with oil films over a wide area. As a result, the durability of the vane sliding surface can be improved and as well as the compression efficiency can be improved.

According to the present invention, there is provided a rolling piston rotary type or slide vane rotary type multi-stage gas compressor arranged in such a manner that a multi-stage compression mechanism is constituted by sequentially connecting a plurality of compression elements in series. Furthermore, an oil supply passage is formed to pass the back side chamber of each vane, the oil supply passage causing lubricating oil, on which discharge pressure acts, to be introduced into the back side chamber of a vane of the final stage compression elements of vanes for sectioning cylinders of the compression elements into the suction chamber and the compression chamber when the vanes advance and retract (move forward/rearward) in the cylinders of the compression elements. In addition, lubricating oil is introduced into the back side of each vane of the compression element except for the final stage compression element after its pressure has been lowered to a level of the discharge from each compression element. The back side of each vane is applied with the pressure of lubricating oil. Furthermore, the oil supply passage having a throttle portion is formed in the conjunction surface of an intermediate plate and a cylinder member, the intermediate plate establishing a connection between cylinder members of adjacent compression elements. As a result, the oil supply passage the throttle portion of which must have an excellent accuracy can be easily formed in the conjunction surface portion between the intermediate plate and the end surface of the cylinder. Therefore, the cost of the elements can be reduced. In addition, lubricating oil can be stably supplied to the back side chamber of the vane of the low stage compression element to compensate the pressure difference. Therefore, pressure can be equally applied to the back side of the vane, the gap in the compression chamber can be sealed with oil films and the wear and friction can be reduced. As a result, the compression efficiency can be improved and reliability can also be improved.

According to the present invention, there is provided a rolling piston rotary type or slide vane rotary type multi-stage gas compressor arranged in such a manner that a multi-stage compression mechanism is constituted by sequentially connecting a plurality of compression elements in series. Furthermore, an oil supply passage is formed to pass the back side chamber of each vane, the oil supply passage causing lubricating oil, on which discharge pressure acts on, to be introduced into the back side chamber of a vane of the final stage compression elements of vanes for sectioning cylinders of the compression elements into the suction chamber and the compression chamber when the vanes advance and retract (move forward/rearward) in the cylinders of the compression elements. In addition, lubricating oil is introduced into the back side of each vane of the compression element except for the final stage compression element after its pressure has been lowered to a level of the discharge from each compression element. The back side of each vane is applied with the pressure of lubricating oil. Furthermore, a two stage compression mechanism composed of a low stage compression element and a high stage compression element is constituted. In addition, a discharge chamber of the low stage compression element is disposed in the lower stream side of the back side chamber of the vane of the low stage compression element so that the oil supply passage is constituted. Therefore, lubricating oil, which is present in the closed container and on which the discharge pressure from the high stage compression element acts, is reduced in its pressure via the oil supply passage having the throttle portion before it is, together with the low stage discharge gas, introduced into the cylinder of the high stage compression element via the back side chamber of the vane of the low stage compression element and the discharge chamber of the low stage compression element. Therefore, in the back side chamber of the vane of the low stage compression element positioned at an intermediate position of the above-described route, proper pressure the level of which is the same as the low stage discharge pressure is applied to the back side of the vane. In addition, the sliding surface can be lubricated. In the cylinder of the high stage compression element, each sliding surface can be lubricated with oil films and impact noises generated between the piston and the tip end of the vane can be eliminated. Furthermore, the gap in the compression chamber can be sealed with oil films to prevent a gas leakage taken place during the compression operation. As a result, the durability of the sliding surface can be improved, the compression efficiency of the high stage compression element can be improved and the noises can be eliminated.

After the operation of the compression has been stopped, lubricating oil present in the oil reservoir is accumulated in the low stage discharge chamber by virtue of the oil supply which is performed by utilizing the residual pressure difference. As a result, a preparation for the oil supply to the back side pressure chamber at the time of the re-starting of the operation of the compressor can be made.

According to the present invention, there is provided a rolling piston rotary type or slide vane rotary type multi-stage gas compressor arranged in such a manner that a multi-stage compression mechanism is constituted by sequentially connecting a plurality of compression elements in series. Furthermore, an oil supply passage is formed to pass the back side chamber of each vane, the oil supply passage causing lubricating oil, on which discharge pressure acts on, to be introduced into the back side chamber of a vane of the final stage compression elements of vanes for sectioning cylinders of the compression elements into the suction chamber and the compression chamber when the vanes advance and retract (move forward/rearward) in the cylinders of the compression elements. In addition, lubricating oil is introduced into the back side of each vane of the compression element except for the final stage compression element after its pressure has been lowered to a level of the discharge from each compression element. The back side of each vane is applied with the pressure of lubricating oil. Furthermore, the opening of the connecting passage formed from the discharge chamber of the low stage compression element to the back side chamber of the vane is positioned in the upper portion of the back side chamber. Therefore, the undesirable discharge of lubricating oil, which has been supplied from the closed container to the back side chamber of the vane via the oil supply passage, into the low stage discharge chamber via the oil returning passage during the operation of the compressor or the time at which the same is stopped can be prevented. Therefore, a predetermined quantity of lubricating oil can always be secured. As a result, the sliding surface of the vane can be lubricated and the gap between the sliding surfaces can be sealed with oil films. Therefore, the durability of the vane sliding surface can be improved and undesirable introduction of lubricating oil present in the back side chamber and that of the refrigerant gas into the cylinder via the gap in the vane can be prevented. As a result, input loss can be prevented.

According to the present invention, there is provided a rolling piston rotary type or slide vane rotary type multi-stage gas compressor arranged in such a manner that a multi-stage compression mechanism is constituted by sequentially connecting a plurality of compression elements in series. Furthermore, an oil supply passage is formed to pass the back side chamber of each vane, the oil supply passage causing lubricating oil, on which discharge pressure acts on, to be introduced into the back side chamber of a vane of the final stage compression elements of vanes for sectioning cylinders of the compression elements into the suction chamber and the compression chamber when the vanes advance and retract (move forward/rearward) in the cylinders of the compression elements. In addition, lubricating oil is introduced into the back side of each vane of the compression element except for the final stage compression element after its pressure has been lowered to a level of the discharge from each compression element. The back side of each vane is applied with the pressure of lubricating oil. Furthermore, a two stage compression mechanism composed of a low stage compression element and a high stage compression element is constituted. In addition, the oil supply passage is constituted in such a manner that a discharge chamber of the low stage compression element is disposed in the lower stream of the back side chamber of the vane of the low stage compression element. Furthermore, an opening portion of the lower stream of the vane back side chamber into the discharge chamber is positioned in the bottom portion of the oil reservoir of the discharge chamber. As a result, even if the pressure in the closed container and the temperature of lubricating oil have not been raised sufficiently and thereby the sufficient oil supply to the back side chamber of the vane of the low stage compression element via the oil supply passage having the throttle passage cannot be expected as is in a case of the early stage of cold starting of the compressor, lubricating oil accumulated in the bottom portion of the oil reservoir of the discharge chamber of the low stage compression element can be inversely introduced into the back side chamber of the vane by the low stage discharge gas pressure. As a result, a proper quantity of lubricating oil can be sequentially supplied to the gap in the sliding portion of the vane and the suction chamber of the cylinder to compensate the pressure difference. In addition, the discharge pressure from the low stage compression element is caused to act on the back side of the vane of the low stage compression element from the early stage of the starting of the operation of the compressor. Therefore, a proper contact pressure can be applied to the tip end of the vane. As a result, while preventing jumping with respect to the piston (or the inner wall of the cylinder), the vane is able to always section the inside portion of the cylinder into the suction chamber and the compression chamber from the early stage of starting of the operation of the compressor so that the compression chamber is sealed. In addition, impact noises between the vane and the piston (or the inner wall of the cylinder) can be eliminated. As a result, the durability of the vane and the piston (or the inner surface of the cylinder) can be improved, noises can be eliminated and the compression efficiency can be improved at the time of the early stage of starting of the operation of the compressor.

According to the present invention, there is provided a rolling piston rotary type or slide vane rotary type multi-stage gas compressor arranged in such a manner that a multi-stage compression mechanism is constituted by sequentially connecting a plurality of compression elements in series. Furthermore, an oil supply passage is formed to pass the back side chamber of each vane, the oil supply passage causing lubricating oil, on which discharge pressure acts on, to be introduced into the back side chamber of a vane of the final stage compression elements of vanes for sectioning cylinders of the compression elements into the suction chamber and the compression chamber when the vanes advance and retract (move forward/rearward) in the cylinders of the compression elements. In addition, lubricating oil is introduced into the back side of each vane of the compression element except for the final stage compression element after its pressure has been lowered to a level of the discharge from each compression element. The back side of each vane is applied with the pressure of lubricating oil. Furthermore, a two stage compression mechanism composed of a low stage compression element and a high stage compression element is constituted. In addition, the oil supply passage is constituted in such a manner that a discharge chamber of the low stage compression element is disposed in the lower stream of the back side chamber of the vane of the low stage compression element. Furthermore, an opening portion of the lower stream of the vane back side chamber into the discharge chamber is positioned in the bottom portion of the oil reservoir of the discharge chamber. In addition, a partition plate is disposed in the upper portion of the oil reservoir in the bottom portion of the discharge chamber. Furthermore, a small-diameter passage is formed in the bottom portion of the partition plate, the small-diameter passage establishing a connection between the upper space of the discharge chamber and the oil reservoir chamber. As a result, when lubricating oil accumurated in the bottom portion of the oil reservoir in the discharge chamber is diffused by the flow of the discharge gas discharged from the cylinder of the low stage compression element into the discharge chamber of the low stage compression element, the introduction of the discharge gas into the oil reservoir of the discharge chamber can be absorbed by the partition plate disposed in the upper portion of the oil reservoir of the discharge chamber. Therefore, lubricating oil can always be secured in the oil reservoir of the discharge chamber and thereby the introduction of the discharge gas into the back side chamber of the vane via the oil returning passage can be prevented. As a result, lubricating oil can always be secured in the back side chamber and thereby the gap in the sliding portion of the back side chamber can be sealed with the oil films. Therefore, the counterflow of the discharge gas into the cylinder via the back side chamber can be prevented. Consequently, the deterioration in the compression efficiency can be prevented and the durability of the sliding surface of the vane can be improved.

Other and further objects, features and advantages of the invention will be appear more fully from the following description.

DESCRIPTION OF THE PREFERRED EMBODIMENTS

A first embodiment of a rolling piston rotary type two-stage refrigerant compressor will low be described with reference to FIGS. 1 to 6.

Figure 1:
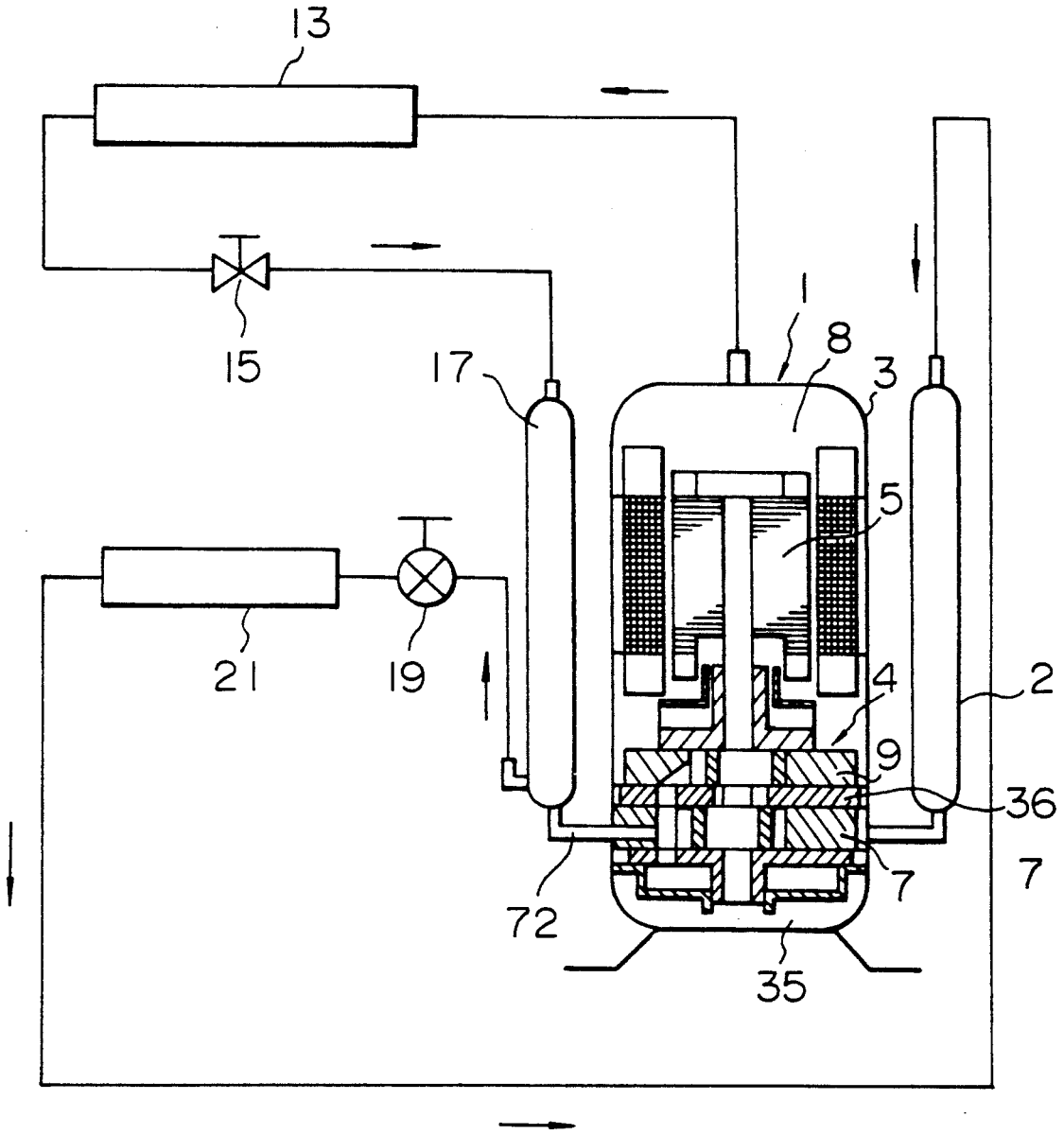
FIG. 1 illustrates a piping system of a two stage compression refrigerating cycle which uses a two stage refrigerant compressor according to a first embodiment of the present invention.
Figure 2:
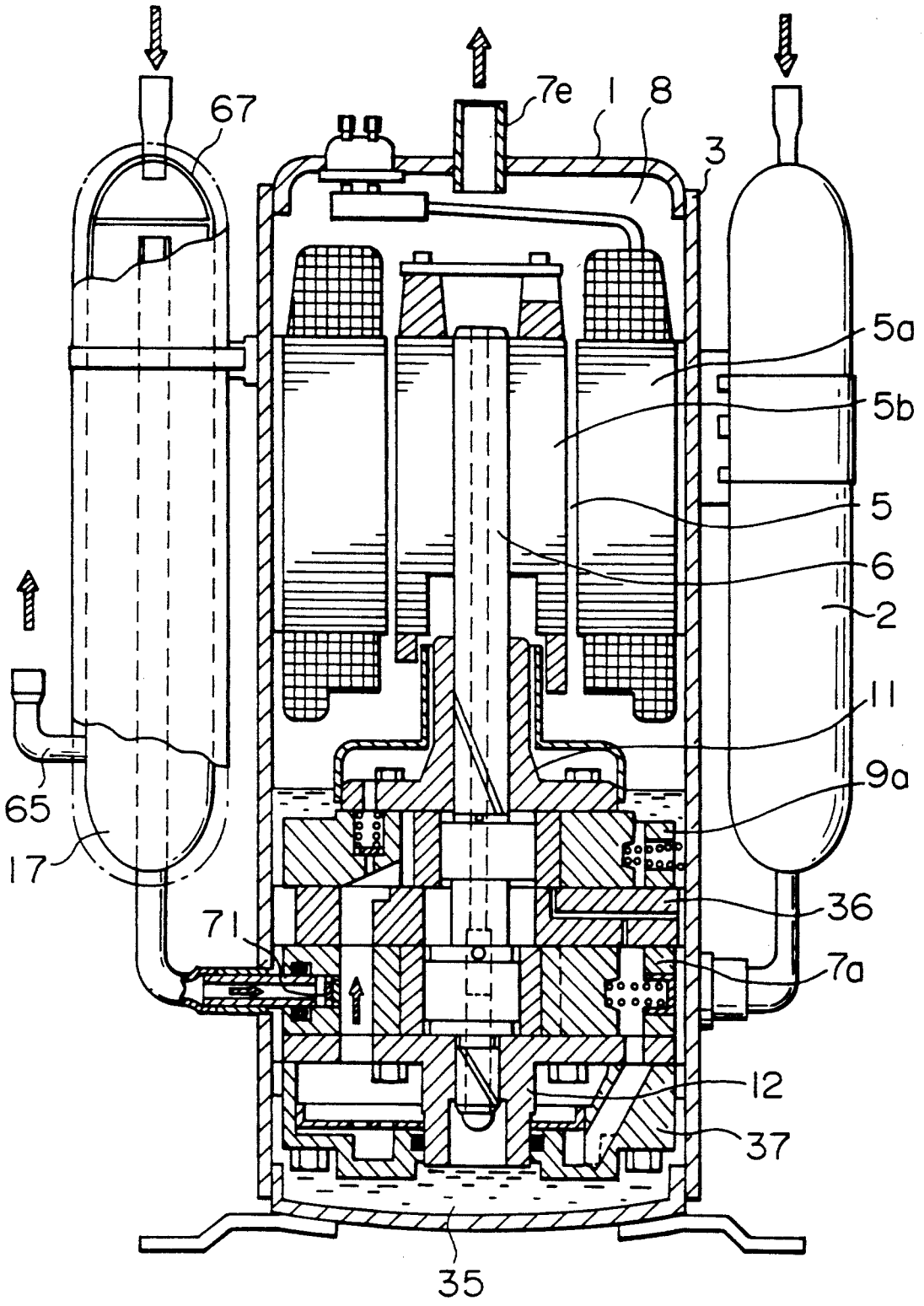
FIG. 2 is a vertical cross sectional view which illustrates the two stage refrigerant compressor.
Figure 3:
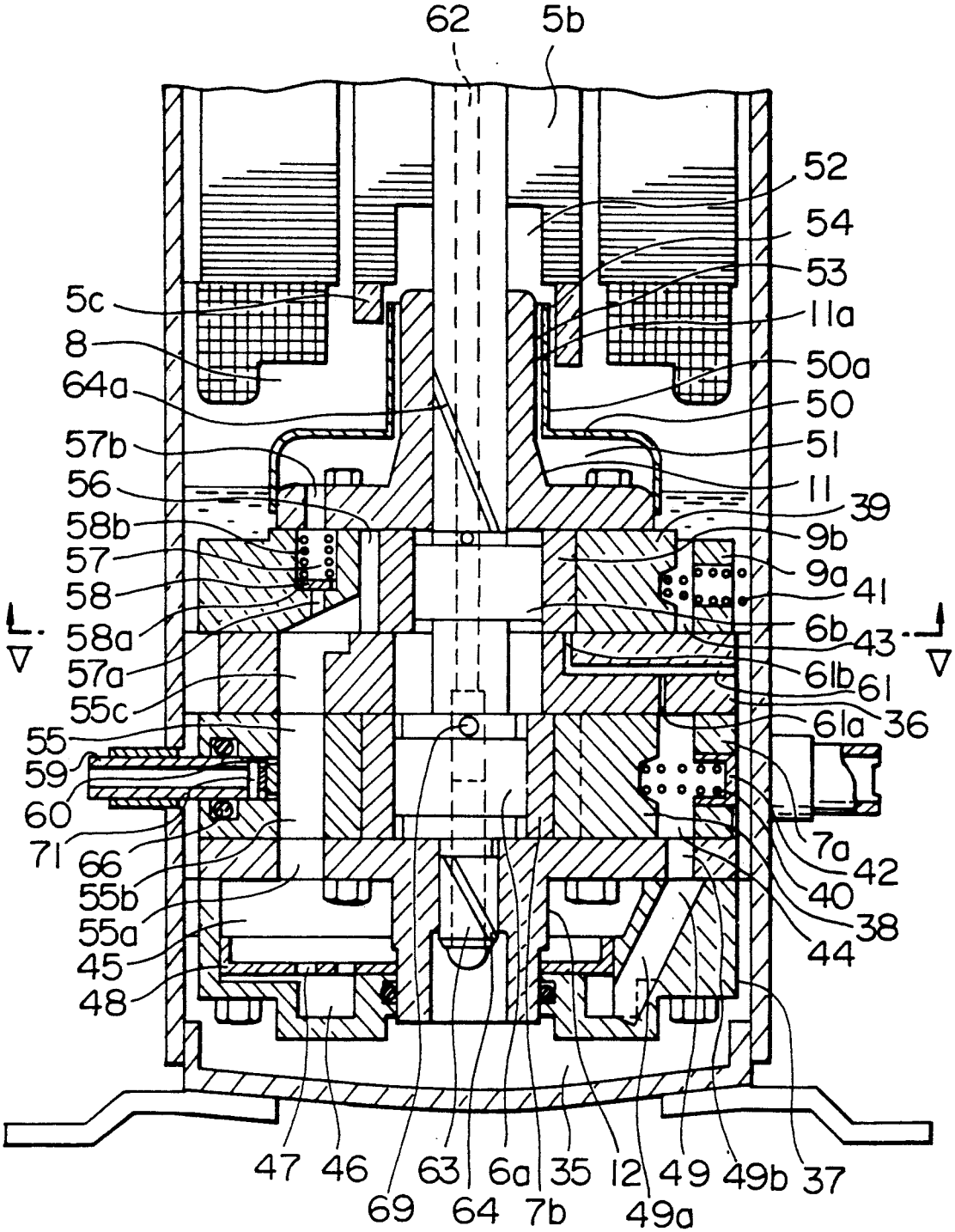
FIG. 3 is a cross sectional view which illustrates an essential portion of a compression portion of the two stage refrigerant compressor.

FIG. 1 illustrates the piping system of a two-stage compression refrigerating cycle constituted by sequentially connecting a rolling piston rotary type two-stage compressor 1 having an accumulator 2, a condenser 13, a first expansion valve 15, a gas-liquid separator 17, a second expansion valve 19 and an evaporator 21. FIG. 2 is a cross sectional view which illustrates the rolling piston rotary type two-stage compressor 1. FIG. 3 illustrates an essential portion of a two-stage compression mechanism.

In a motor room 8 formed in the upper space in a closed container 3, an electric motor 5 is disposed and as well as a two-stage compressor 4 is disposed below the electric motor 5. Furthermore, the outer periphery and the bottom portion of the closed container 3 are formed as an oil reservoir 35.

A stator 5*a* of the electric motor 5 is shrink-fit to the inner wall of the closed container 3.

The two-stage compressor 4 comprises a high stage compression element 9 disposed in the upper portion, a low stage compression element 7 disposed in the lower portion and a flat intermediate plate 36 disposed between the above-described two compression elements 7 and 9, the two-stage compressor 4 being, by welding, secured to the inner wall of the closed container 3 by a discharge cover 37 of the low stage compression element 7 and a plurality of outer portions (omitted from illustration) of the intermediate plate 36.

The cylinder capacity of the high stage compression element 9 is set to about 45 to 65% of the cylinder capacity of the low stage compression element 7.

A drive shaft 6 supported by an upper bearing member 11 fastened to the upper surface of a second cylinder block 9*a* of the high stage compression element 9 and a lower bearing member 12 fastened to the lower surface of a first cylinder block 7*a* of the lower stage compression element 7 is connected and secured to a rotor 5*b* of the electronic motor 5.

A first crank shaft 6*a* and a second crank shaft 6*b* of the drive shaft 6 are disposed in such a manner that their directions of eccentricity are 180° out of phase with each other.

Reference numerals 7*b* and 9*b* respectively represent a first piston and a second piston fastened to the first crank shaft 6*a* and the second crank shaft 6*b*. Reference numerals 38 and 39 represent vanes which are positioned in contact with the outer surfaces of the first piston 7*b* and the second piston 9*b* to section the inside portion of the cylinder of each of the low stage compression element 7 and the high stage compression element 9 into a suction chamber and a compression chamber. Reference numerals 40 and 41 represent coil springs for urging the rear surfaces of the vanes 38 and 39.

The rear end portion of the coil spring 41 of the high stage compression element 9 is supported by the inner wall of the closed container 3, while the rear end portion of the coil spring 40 of the low stage compression element 7 is supported by a cap 42 hermetically fastened to the first cylinder block 7*a*.

A back side chamber 43 of the vane 39 of the high stage compression element 9 is connected to the oil reservoir 35, while the end portion of a back side chamber 44 of the vane 38 of the low stage compression element 7 is sealed by the cap 42 so as to be disconnected from the oil reservoir 35.

The discharge cover 37 of the low stage compression element 7 is, together with the lower bearing member 12, fastened to the first cylinder block 7*a* to form a low stage discharge chamber 45 the bottom portion of which form a discharge chamber oil reservoir 46.

The discharge chamber oil reservoir 46 is sectioned from the upper space of the low stage discharge chamber 45 by a partition plate 48 secured to the discharge cover 37 and having a plurality of apertures 48. Furthermore, the bottom portion of the discharge chamber oil reservoir 46 is connected to the back side chamber 44 of the vane 38 via an oil returning passage 49 constituted by an oil returning holes 49*a* and 49*b* formed in the discharge cover 37 and the lower bearing member 12.

The discharge cover 50 manufactured by molding a vibration-damping steel plate is disposed to surround the upper bearing member 11 and thereby the same forms a high stage discharge chamber 51.

A noise eliminating chamber 52 formed into a concave shape in the end portion of the rotor 5*b* of the electric motor 5 is connected to the high stage discharge chamber 51 via a circular passage 53 formed inside the projecting portion 50*a* of the discharge cover 50 which surrounds a projecting portion 11*a* of the upper bearing member 11. Furthermore, it is connected to the inside space of the closed container 3 via a circular passage 54 formed between the inner surface of an end ring 5*c* of the rotor 5*b* and the projecting portion 50*a* of the discharge cover 50.

The low stage discharge chamber 45 and the suction chamber 56 of the high stage compression element 9 are connected to each other via a connecting passage 55 constituted by a gas passage 55*a* formed in the lower bearing member 12, a gas passage 55*b* formed in the first cylinder block 7*a* and a gas passage 55*c* formed in the intermediate plate 36.

A bypass passage 57 branching at an intermediate position in the connecting passage 55 is constituted by a bypass passages 57*a* and 57*b* formed in the second cylinder block 9*a* of the high stage compression element 9 and the upper bearing member 11, the lower stream portion of the bypass passage 57 being connected to the high stage discharge chamber 51.

The bypass passage 57*a* has a bypass valve device 58 fastened thereto, the bypass valve device 58 comprising a valve body 58*a* (as for the shape, see FIG. 4) which has a cut portion formed in its outer periphery thereof and which is made of a thin steel plate and a coil spring 58*b*. The bypass valve device 58 allows fluid to flow only in a direction from the connecting passage 55 to the high stage discharge chamber 51.

The coil spring 58b has shape memory alloy characteristics which enables the spring constant of the coil spring 58b to be increased when its temperature arises. Therefore, the force of the coil spring 58b for urging the valve body 58a is increased in proportion to the temperature.

The gas passage 55b which constitutes a portion of the connecting passage 55 is connected to the lower stream of the gas-liquid separator 17 via a connecting pipe 59 so as to form a refrigerant injection passage 72.

Figure 4:
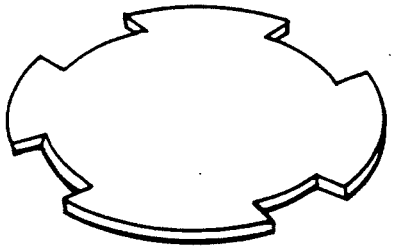
FIG. 4 illustrates the appearance of a bypass device for use in the two stage refrigerant compressor.

The connecting pipe 59 is inserted into the cylinder block 7a and the outer surface of their junction is sealed by an "0" ring 66. Furthermore, a valve body 60 formed similarly to that shown in FIG. 4 is disposed between the end portion of the connecting pipe 59 and the gas passage 55b so that a check valve device 71 is constituted.

The check valve device 71 is arranged to allow fluid to be introduced only in a direction from the gas-liquid separator 17 to the gas passage 55b.

The intermediate plate 36 has an oil injection passage 61 at an intermediate portion thereof, the oil injection passage 61 having a throttle portion formed at an intermediate portion thereof. The upper stream portion from the oil injection passage 61 is intermittently connected to the oil reservoir 35, while the lower stream portion of the same is intermittently connected to the back side chamber of the vane 38 and the compression chamber of the high compression element 9.

The lower stream passage 61a of the oil injection passage 61 and the back side chamber 44 are formed at the end surface of the slide side of the vane so as to be connected to each other when the vane 38 has covered substantially the half way point toward the piston 7b and disconnected from each other in the other cases.

Figure 5:
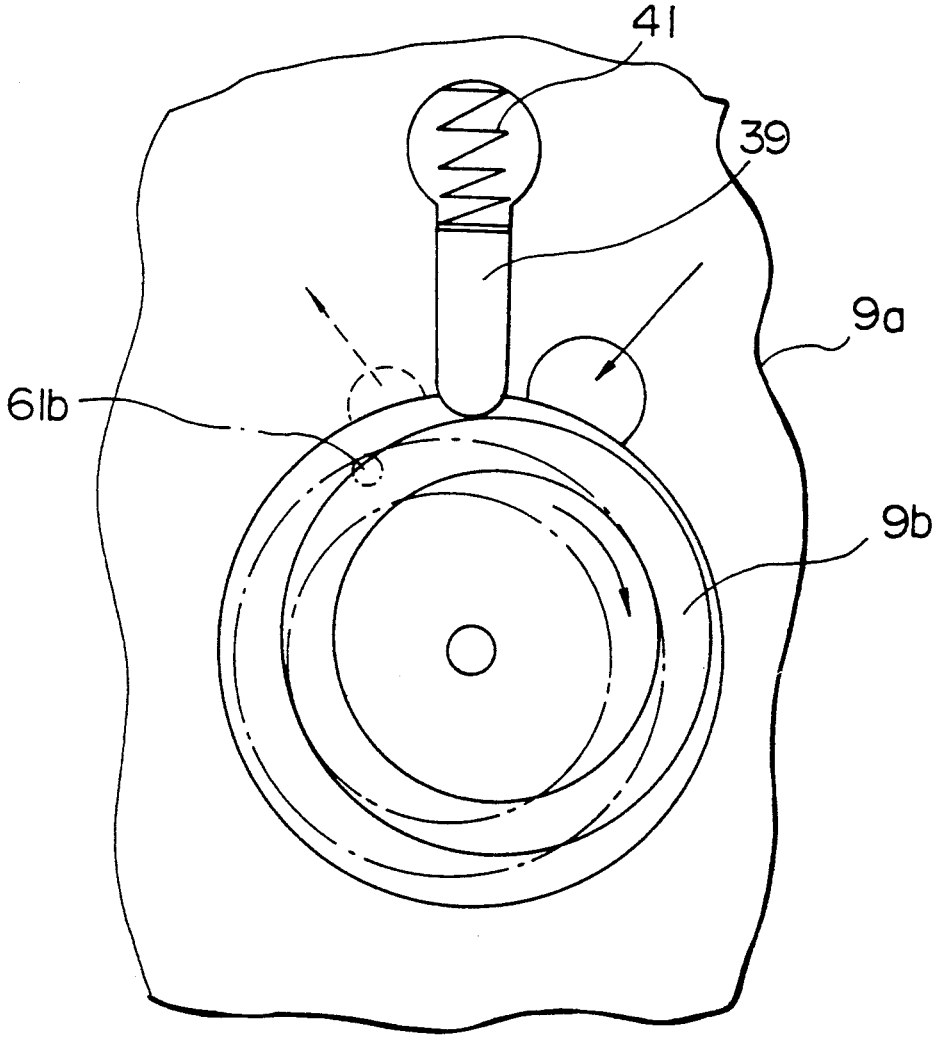
FIG. 5 is a partial plan view taken along line V—V of FIG. 3.

The upper stream passage 61b of the oil injection passage 61 and the compression chamber of the high stage compression element 9 are opened at positions so as to be connected to each other when the vane has covered substantially ⅓ of the overall stroke toward the piston 7b and disconnected by the end surface of the slide side of the piston 9b when the vane 39 has moved back to the position of the ⅓ stroke of the overall stroke (see FIG. 5).

The drive shaft 6 has a through shaft hole 62 formed in the shaft core portion thereof and a pump unit 63 is mounted on a portion below the shaft hole 62.

Spiral oil grooves 64 and 64a are formed on the outer surface of the drive shaft 5 supported by the upper bearing member 11 and the lower bearing member 12. The upper stream from the spiral oil groove 64 is connected to the lower stream of the pump unit 63 via a radial directional oil hole branching from the shaft hole 62, while the lower stream of the spiral oil groove 64 is not connected to the noise eliminating chamber 52.

The lower stream of the accumulator 2 is connected to a suction chamber (omitted form illustration) of the low stage compression element 7 and a discharge pipe 7e is disposed in the upper portion of the closed container 3.

A liquid pipe 65 connected to the second expansion valve 19 is connected to the bottom portion of the gas-liquid separator 17. The outer surface of the gas-liquid separator 17 is subjected to a heat maintaining treatment with foam polyethylene 67 foamed to about 5 mm by heat applied after the outer surface of the gas-liquid separator 17 has been coated with a polyethylene film.

Figure 6:
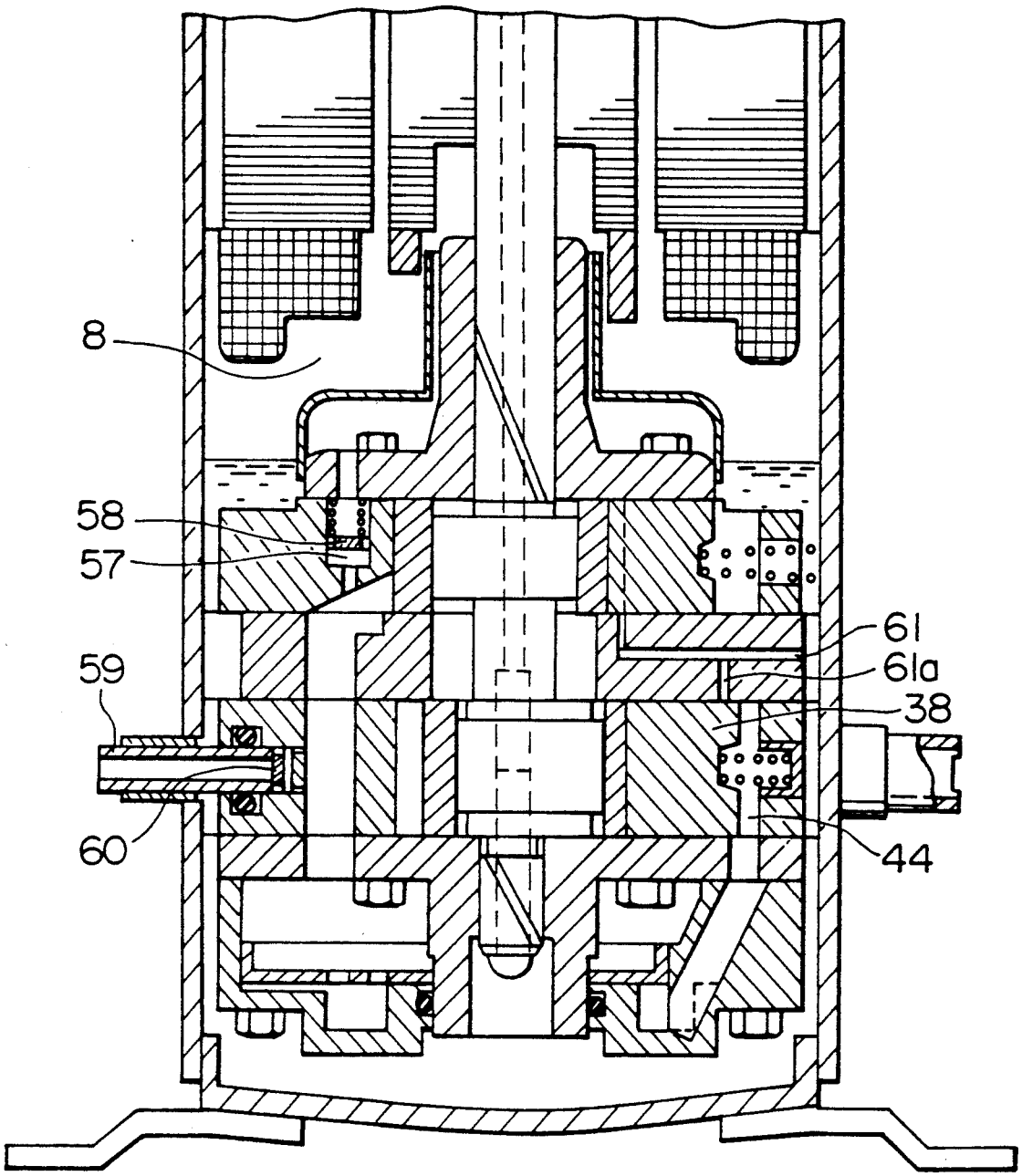
FIG. 6 is a vertical cross sectional view which illustrates the bypass valve device and a check valve device of the two stage refrigerant compressor after their valve bodies have been moved.

FIG. 6 illustrates a state in which the bypass passage 57 is opened after the refrigerating operation of the compressor has been started, a state in which the end portion of the connecting pipe 59 is closed by the valve body 60 and a state in which a portion between the lower stream passage 61a of the oil injection passage 61 and the back side chamber is closed by the vane 38.

Figure 7:
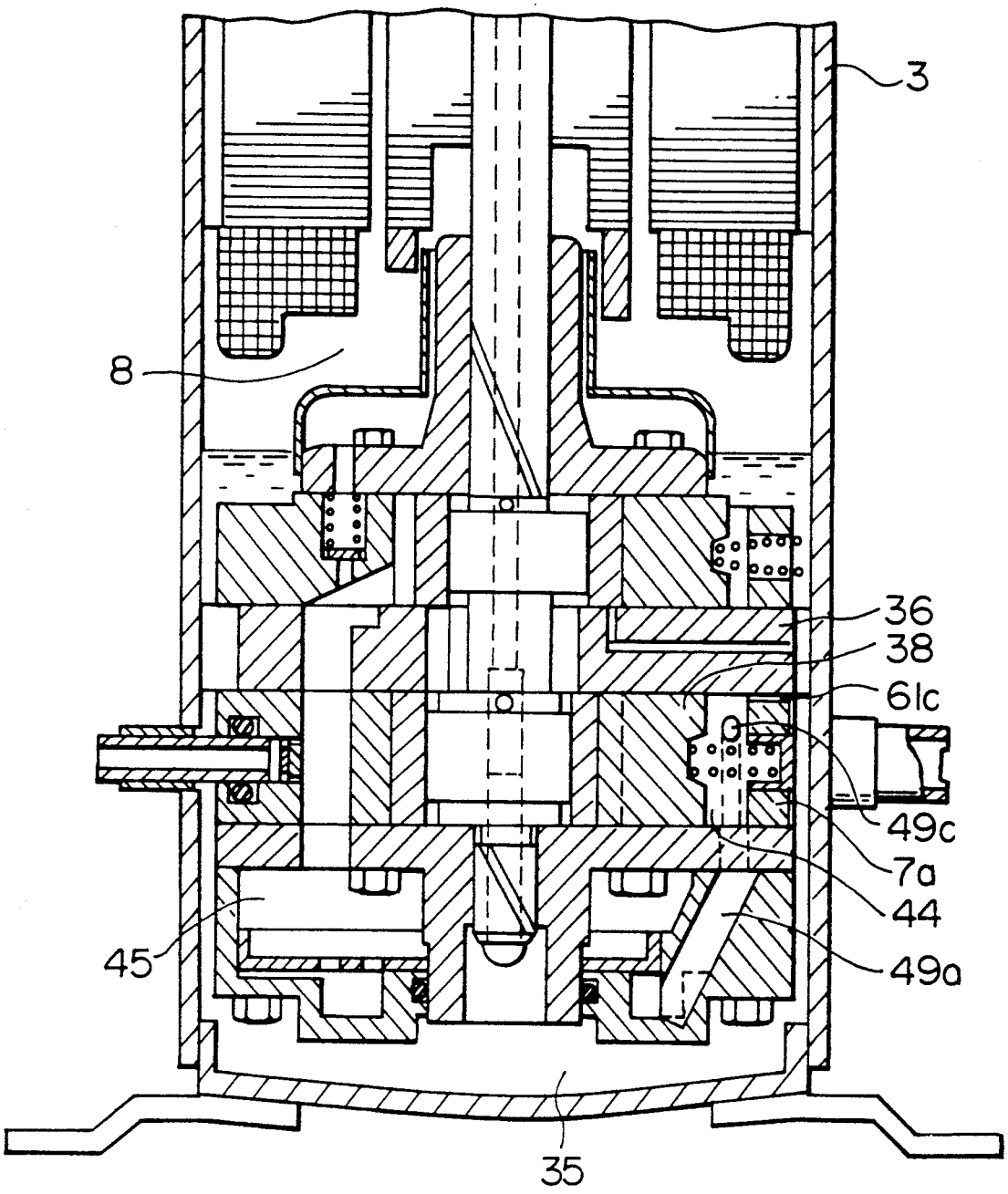
FIG. 7 is a cross sectional view which illustrates an essential portion of a compression portion of the two stage refrigerant compressor according to a second embodiment of the present invention.

FIG. 7 illustrates a second embodiment of the present invention which is arranged in such a manner that the oil injection passage 61c having the throttle passage portion for establishing a connection between the oil reservoir 35 and the back side chamber 44 is arranged in such a manner that its through passage is constituted by a very shallow groove is formed at the junction between the intermediate plate 36 and the first cylinder block 7a. Furthermore, the opening of a oil returning hole 49c for returning oil from the low stage discharge chamber 45 to the back side chamber 44 is formed in the upper potion of the back side chamber 44.

Figure 8:
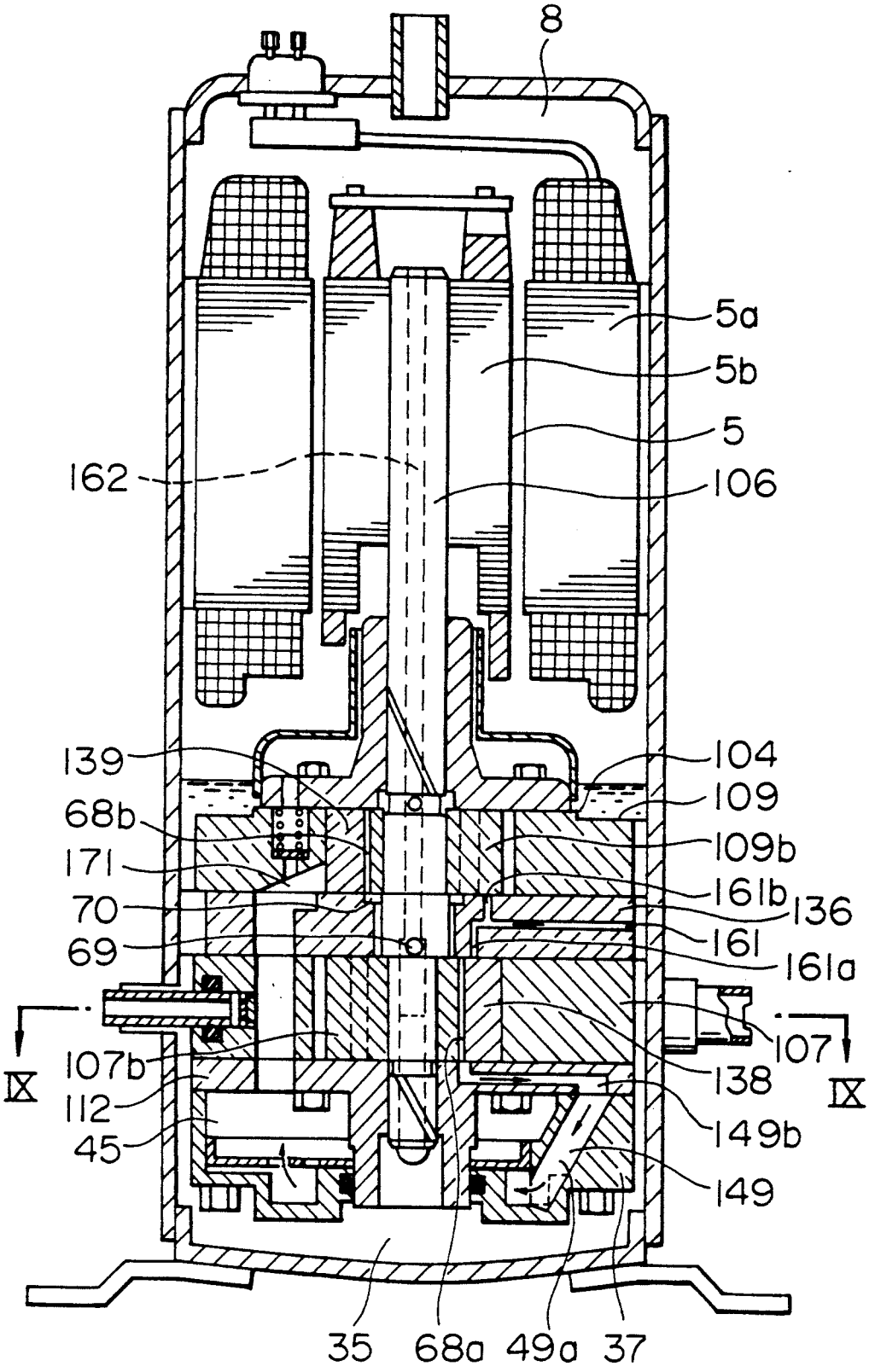
FIG. 8 is a vertical cross sectional view which illustrates a third embodiment of the two stage refrigerant compressor according to the present invention.
Figure 9:
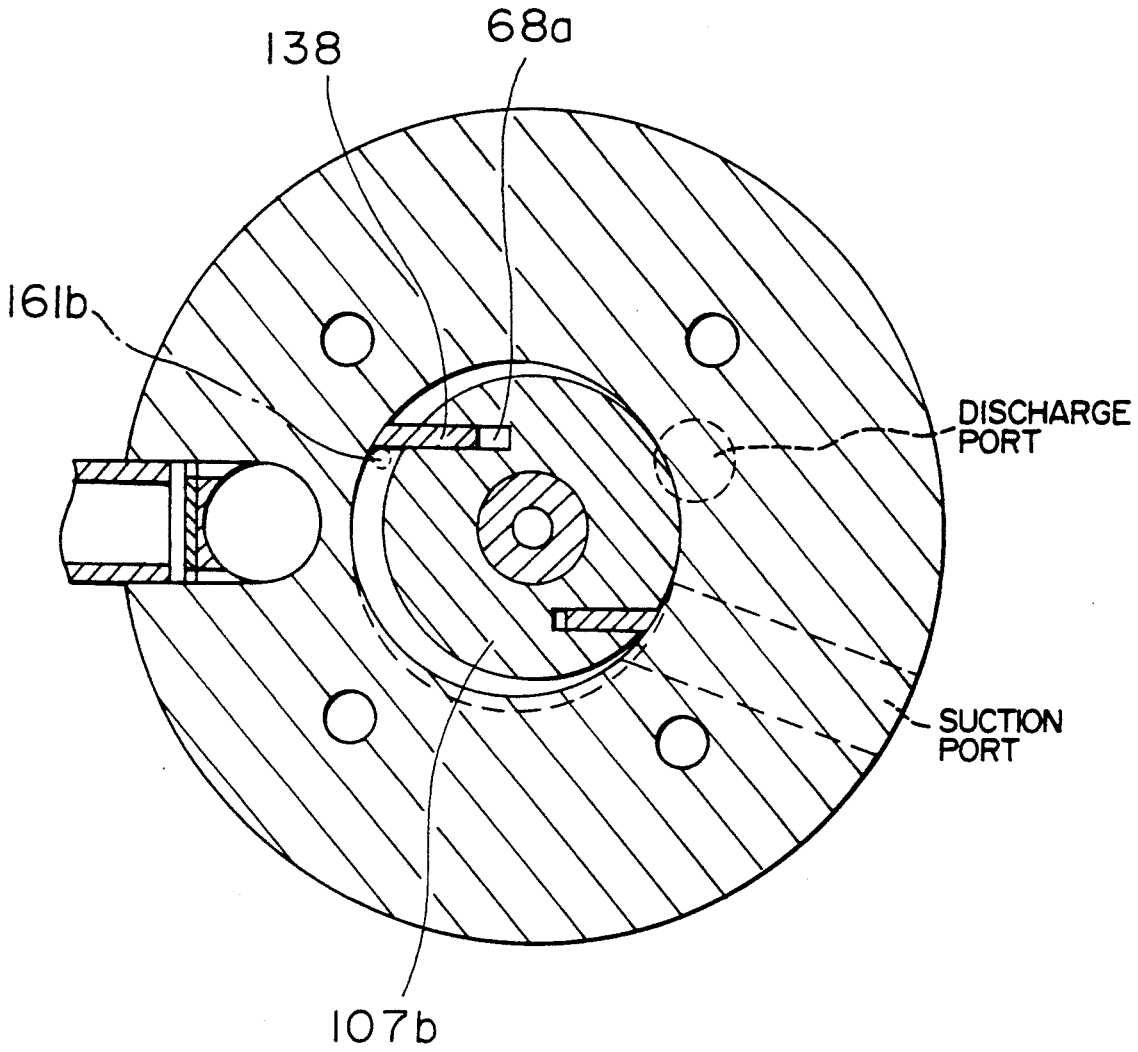
FIG. 9 is a partial cross sectional view taken along line IX—IX of FIG. 8.

Then, a third embodiment of a slide vane rotary type two-stage refrigerant compressor according to the present invention will now be described with reference to FIGS. 8 and 9.

A two-stage compression mechanism 104 is, similarly to the first embodiment of the present invention, constituted by sequentially disposing a high stage compression element 109 in the upper stage thereof, an intermediate plate 136 and a low stage compression element 107.

A first rotor 107b and a second rotor 109b are disposed and secured to a drive shaft 106 connected to the rotor 5b of the electric motor 5 in such a manner that the high stage compression element 109 commences the suction/compression operation while being delayed by about 60 degrees to 80 degrees from the timing at which the low stage compression element 107 performs the suction/compression operation. A vane 138 is disposed in a vane groove 68a formed in the first rotor 107b, while a vane 139 is disposed in a vane groove 68b formed in the second rotor 109b.

The vane groove 68b of the high stage compression element 109 and the oil reservoir 35 are always connected to each other via a shaft hole 162 penetrating the drive shaft 106, the radial directional hole 69 branching from the shaft hole 162 and an annular groove 70 formed in the side surface of the second rotor 109b of the intermediate plate 136.

An upper stream passage 161b of the oil injection passage 161 having the throttle passage portion formed in the intermediate plate 136 is, similarly to the first embodiment, intermittently connected to the compression chamber of the high stage compression element 109. The position at which the lower stream passage 161b is opened in the compression chamber corresponds to the front position for the forward movement of the vane 139.

The lower stream passage 161a of the oil injection passage 161 is intermittently connected to the vane groove 68a when the first rotor 107b of the low stage compression element 107 rotates. The vane groove 68a is connected to the low stage discharge chamber 45 via an oil returning passage 149 composed of an oil returning hole 149b formed in the lower bearing member 112 of the low stage compression element 107 and an oil returning hole formed in the discharge cover 37.

Since the other structures are the same as those according to the first embodiment of the present invention, their descriptions are omitted here.

Figure 10:
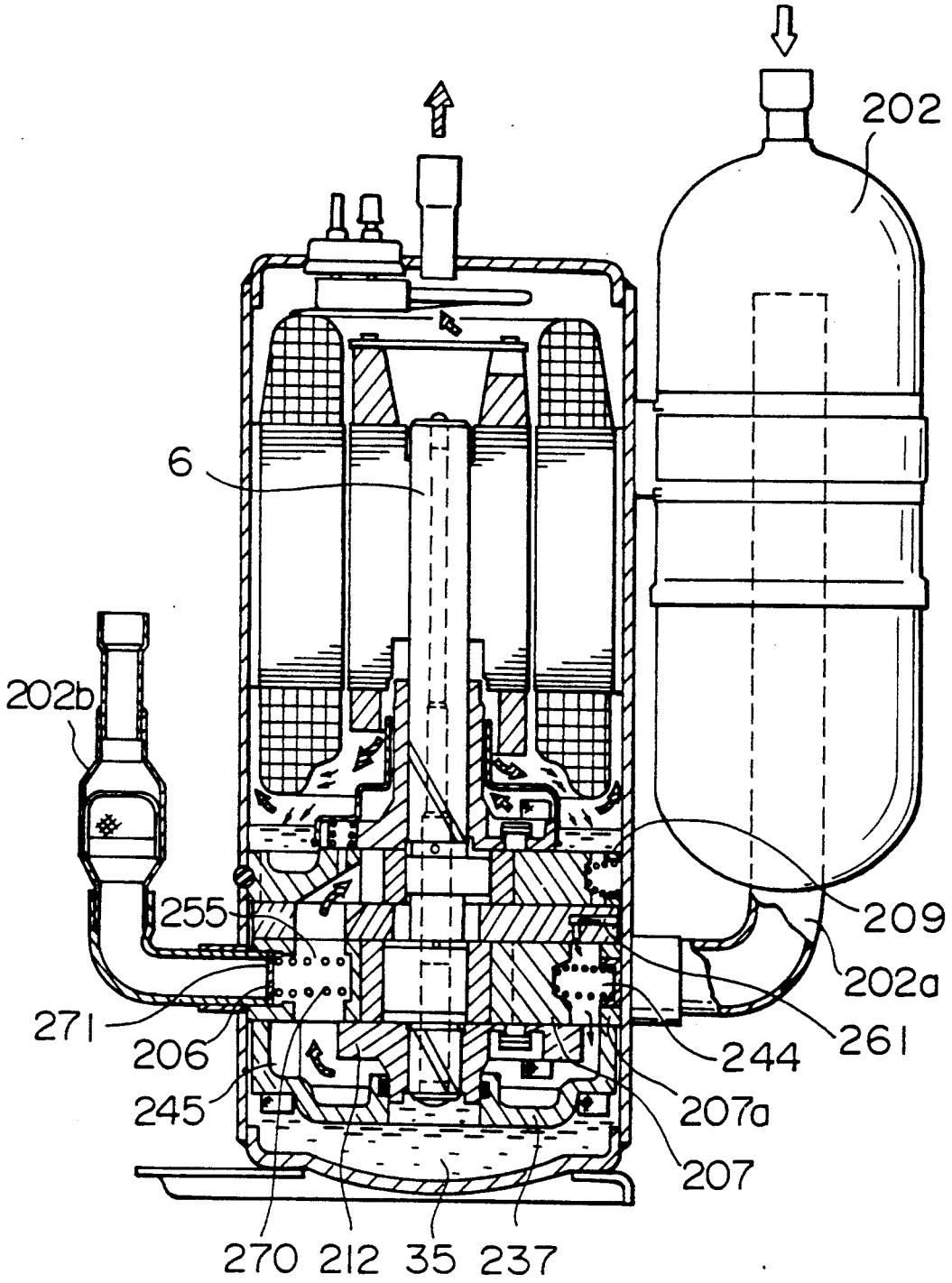
FIG. 10 is a vertical cross sectional view which illustrates a fourth embodiment of the two stage refrigerant compressor according to the present invention.
Figure 11:
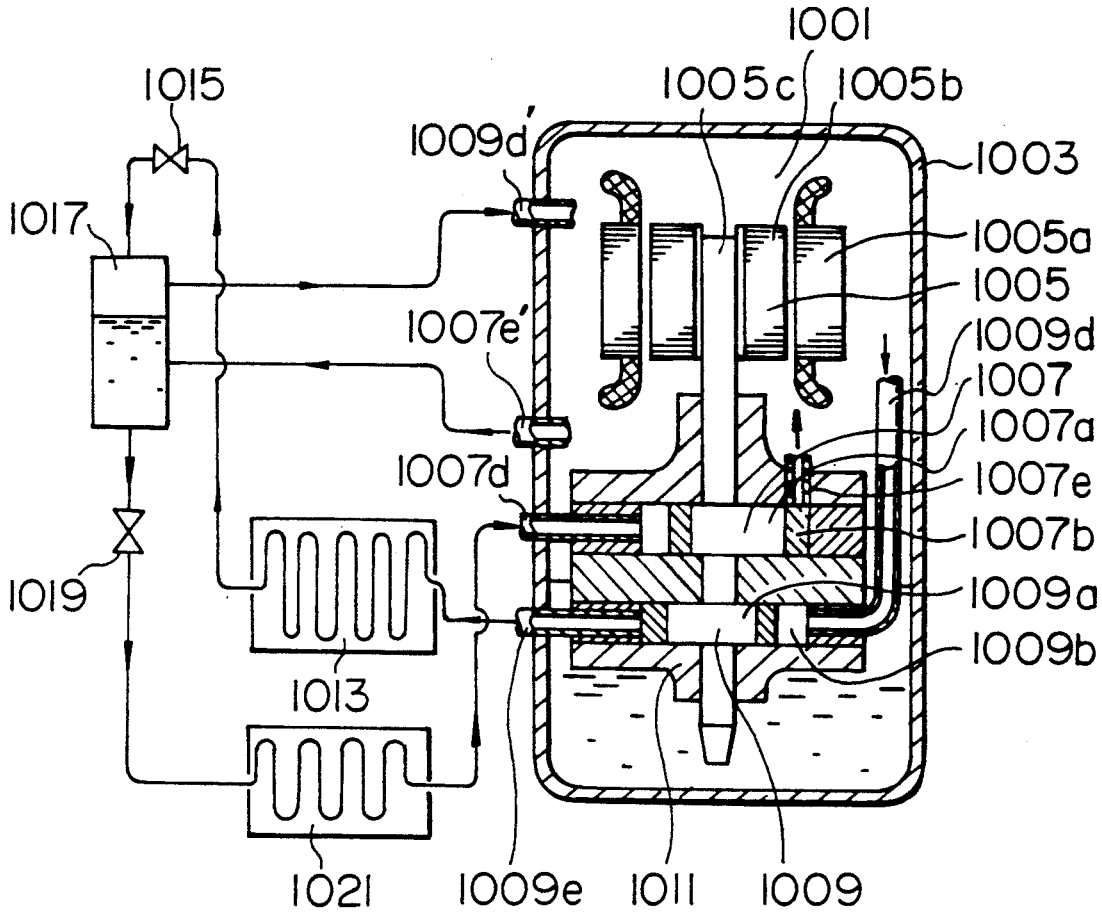
FIG. 11 PRIOR ART
FIG. 11 illustrates a piping system of a two stage compression refrigerating cycle which uses a conventional two stage refrigerant compressor.
Figure 12:
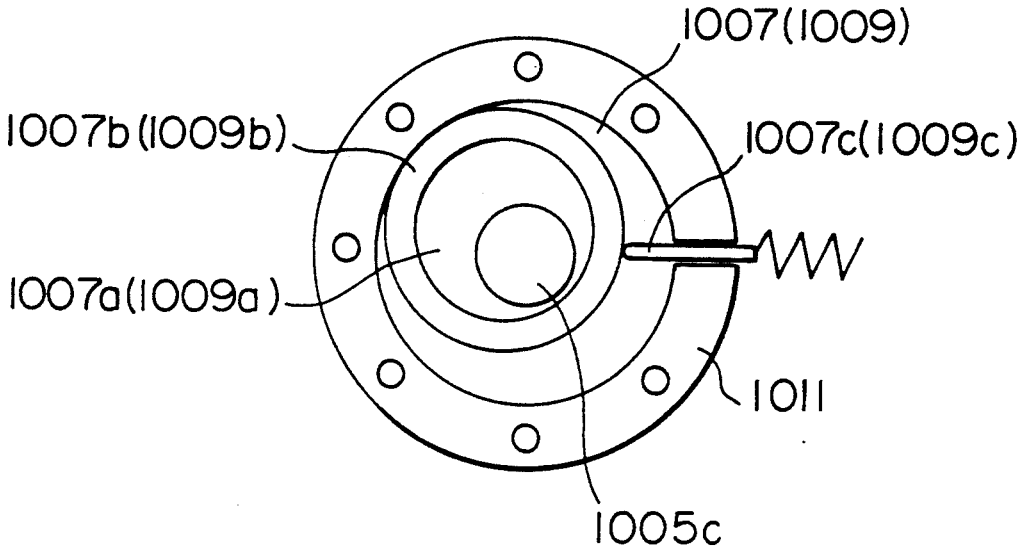
FIG. 12 PRIOR ART
FIG. 12 is a plan view which illustrates a compression mechanism of the conventional two stage refrigerant compressor.
Figure 13:
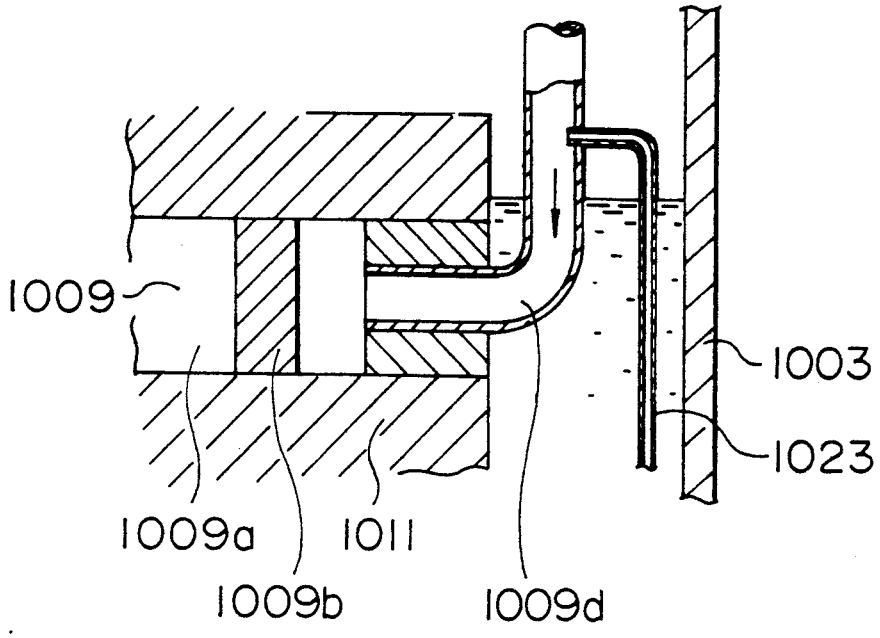
FIG. 13 PRIOR ART
FIG. 13 illustrates a lubricating device of the conventional two stage refrigerant compressor.

Then, the structure of a low stage compression element and that of an oil supply passage connected to it of a rolling piston rotary type two-stage refrigerant compressor according to a fourth embodiment of the present invention will now be described with reference to FIG. 10.

Similarly to the first embodiment of the present invention, the lower stream of a first accumulator 202 is connected to the suction side of a low stage compression element 207, the first accumulator 202 having a suction pipe 202*a* the inner diameter of which is about 1.5 times the inner diameter of a suction pipe of an accumulator for use in a conventional single-stage compressor so that the supercharge effect (pulsation takes place in the pressure of a gas in the suction pipe due to the suction operation performed by the compressor and the suction efficiency is raised because the above-described gas, the pressure of which has been periodically raised, is introduced into the suction chamber and the same is compressed as it is) of the accumulator is restricted.

A low stage discharge chamber 245 of the low stage compression element 207 is formed by a discharge cover 237 and a first cylinder block 207*a*, the discharge cover 237 being fastened to a first cylinder block 207*a* to surround a lower bearing member 212 which supports the drive shaft 6. Furthermore, the internal capacity of the low stage discharge chamber 245 is made to be smaller than that according to the first embodiment of the present invention.

A high stage compression element 209 is disposed in such a manner that it is able to commence its suction/-compression operation while being delayed by about 60 degrees to 80 degrees from the timing at which the low stage compression element 207 performs the suction/-compression operation so as to prevent an excessive rise of the pressure in the low stage discharge chamber 245 and to reduce the compression power required for the low stage compression element 207.

A low stage discharge chamber 245 connected to a back side chamber 244 is, at its upper portion, connected to the suction side of the high stage compression element 209 via a connecting passage 255. A second accumulator 202*b* connected to the connecting passage 255 at an intermediate position of the above-described connection passage is, at its upper stream, connected to a gas-liquid separator (omitted from illustration) arranged similarly to the first embodiment. Furthermore, a valve body 206 arranged similarly to the first embodiment is fastened to the lower stream end portion of the connected portion.

Since the other structures are the same as those according to the first embodiment of the present invention, their descriptions are omitted here.

Then, the operation of the two-stage compressor thus-constituted and that of its refrigerant cycle will now be described.

Referring to FIGS. 1 to 6, when the drive shaft 6 is rotated by the motor 5, the low stage compression element 7 and the high stage compression element commence the suction/compression operations. As a result of this, a refrigerant gas introduced from the accumulator 2 into the suction chamber of the low stage compression element 7 is compressed and thereby its pressure is raised. Then, the refrigerant gas is discharged into the low stage discharge chamber 45 through a discharge port (omitted from illustration) formed in the lower bearing member 12. The refrigerant gas discharged into the low stage discharge chamber 45 is, via the oil returning passage 49 composed of the oil returning holes 49*a* and 49*b*, inversely introduced into the back side chamber 44 together with lubricating oil accumulated in the bottom portion in the discharge chamber oil reservoir 46. As a result, the back side of the vane 38 is, by the back pressure, urged toward the first piston 7*b*.

The discharged refrigerant gas, the pressure of which has been raised more than the pressure of the refrigerant in the internal space of the closed container 3, flows to the condenser 13 which is connected via piping to the rolling piston rotary type two-stage compressor 1 via the gas-liquid separator 17 and is sent to the suction chamber 56 of the high stage compression element 9 via the connecting passage 55 comprising the gas passages 55*a*, 55*b* and 55*c*.

The pressure of the connecting passage 55 is higher than the pressure in the high stage discharge chamber 51 connected to the internal space of the closed container 3. Therefore, as shown in FIG. 6, the valve body 58*a* of the check valve device 58 moves toward the coil spring 58*b* against the urging force of the coil spring 58*b* so that the bypass passage 57 is opened. Therefore, a portion of the refrigerant gas passing through the connecting passage 55 is discharged to the high stage discharge chamber 51 so that the pressure of the refrigerant gas in the suction chamber 56 is lowered. As a result, the vane 39 of the high stage compression element 9 which depends upon only the urging force of the coil spring 41 is moved back while following the motion of the outer surface of the second piston 9*b* while preventing a jumping phenomenon which can be taken place at the time of its rapid rearward movement due to a rapid introduction of the refrigerant gas, the pressure of which has been raised, into the suction chamber 56. As a result, a light load compression operation can be smoothly commenced while preventing undesirable impact noises generated between the vane 39 and the second piston 9*b* and the leakage of the compressed gas.

The discharged refrigerant gas discharged into the high stage discharge chamber 51 is introduced into the noise eliminating chamber 52 via the circular passage 53. Then, it is sent to the internal space of the closed container 3 via the annular passage 54.

On the other hand, the valve body 60 of the check valve device 71 is moved toward the connecting pipe 59 due to the difference in the pressure between the discharged refrigerant gas passing through the connecting passage 55 and the gas-liquid separator 17. As a result, the end portion of the connecting pipe 59 is closed so that the undesirable counterflow of the discharged refrigerant gas present in the connecting passage 55 into the gas-liquid separator 17 is prevented.

With the time after the compressor has commenced its operation, the pressure in the motor room 8, that in the condenser 13 connected to the motor room 8 and that in the gas-liquid separator 17 are raised. As a result, the valve body 58*a* of the bypass device 58 disposed in the bypass passage 57 is urged by the gas pressure in the high stage discharge chamber 51 and the coil spring 58*b* so that the bypass passage 57 is closed. Furthermore, the valve body 60 which has closed the end portion of the connecting pipe 59 is moved toward the connecting passage 55 so that the gas-liquid separator 17 and the connecting passage 55 are connected to each other.

The lubricating oil present in the oil reservoir 35, to which the discharge pressure effects, urges the back side of the vane 39 together with the coil spring 41 of the high stage compression element 9. Furthermore, a small quantity of the lubricating oil is introduced into the suction chamber 56 and the compression chamber via the gap present in the sliding surface while lubricating the sliding surface of the vane 39. The lubricating oil is intermittently supplied to the compression chamber after its pressure has been reduced when it passes through the lower stream passage 61*b* of the oil injection passage 61 having the throttle passage portion so as to seal the gap in the compression chamber with an oil film and to lubricate the sliding surface of the second piston 39.

The pressure of the lubricating oil present in the oil reservoir 35 is, via the lower stream passage 61*a* of the oil injection, lowered to a level which corresponds to the discharge pressure from the low stage compression element 7. Then, the above-described lubricating oil is introduced into the back side chamber 44 when the opening of the lower stream passage 61*a* is connected to the back side chamber 44 during a time period from a moment at which the vane 38 of the low stage compression element 7 has moved forward to about the ⅓ position toward the first piston to the moment at which the same is moved back to the ⅓ position.

The lubricating oil introduced into the back side chamber 44 lubricates the sliding surface of the vane 38 and as well as the same is introduced into the low stage discharge chamber 45 via the oil returning holes 49*b* and 49*a* before it is mixed with the discharged refrigerant gas. The mixture gas is then introduced into the suction chamber 56 of the high stage compression element 9. The lubricating oil introduced into the suction chamber 56 of the high stage compression element 9 joins the lubricating oil introduced via the back side chamber 43 and the upper stream passage 61 so as to seal the gap in the compression chamber and to lubricate and cool the lubricating surface.

The lubricating oil in the oil reservoir 35 is, by the viscous pumping effect realized by the spiral oil groove 64 formed in the surface of the drive shaft 6 and the pump unit 62 disposed below the drive shaft 6, supplied to the bearing surface of each of the lower and the upper bearing members 12 and 11 for supporting the drive shaft 6 and the inside surface of each of the first and second pistons 7*b* and 9*b* via the shaft hole 62 and the radial directional hole 69. The lubricating oil supplied to the spiral oil groove 64*a* is discharged into the noise eliminating chamber 52 through the top end portion of the bearing of the upper bearing member 11 by the viscous pumping effect. Then, it is mixed with a two-stage high pressure discharged gas discharged from the high stage discharge chamber 52 before it is discharged into the motor room 8 via the annular passage 54.

A discharged refrigerant gas from which the lubricating oil has been removed in the motor room 8 is sent to the refrigerant cycle on the outside of the compressor via the discharge pipe 7*e*.

A non-evaporated refrigerant, which has been reduced in pressure via the condenser 13 and the first expansion valve 15, is expanded to a level which corresponds to the discharged pressure from the low stage compression element 7 before it is introduced into the gas-liquid separator 17 in which it is then separated into a gas and liquid in such a manner that the liquid refrigerant is accumulated in the bottom portion of the gas-liquid separator 17.

A non-evaporated refrigerant gas present in the upper space in the gas-liquid separator 17 is introduced into the connecting passage 55 in the rolling piston rotary type two-stage compressor 1 via the connecting pipe 59 connected to the upper space in the gas-liquid separator 17. It is then mixed with the discharged refrigerant gas from the low stage compression element 7 so that the temperature of the low stage refrigerant gas discharged from the same is lowered before the mixture gas is introduced into the suction chamber 56 of the high stage compression element 9.

The abnormal temperature rise of the two-stage compressed and discharged refrigerant gas from the high-stage compression element 9 is restricted by introducing the non-evaporated refrigerant gas from the gas-liquid separator 17. As a result, the undesirable contraction of the gap in the sliding portion can be prevented and as well as the abnormal temperature rise of the electric motor 5 can be prevented. Therefore, the input to the compressor can be reduced.

On the other hand, the liquid refrigerant accumulated in the bottom portion of the gas-liquid separator 17 sequentially passes through the second expansion valve 19 and the evaporator 21 via the liquid pipe 65 before it is fed back to the accumulator 2 so as to be subjected to the second expansion and heat absorbance.

Since the refrigerant in the gas-liquid separator 17 is subjected to the heat insulation and the noise elimination by the foam polyethylene disposed to surround the body of the gas-liquid separator 17, the transmission of impact noises can be prevented which will be generated due to the impact between the refrigerant and the inner wall of the gas-liquid separator 17 due to the introduction of the refrigerant into the gas-liquid separator 17. Furthermore, the refrigerant does not absorb heat.

Then, the operation of the second embodiment of the present invention will now be described with reference to FIG. 7.

Lubricating oil present in the bottom portion of the motor room 8 on which the discharge pressure acts is reduced in its pressure when it passes through the lower stream passage 61*c* which has the throttle portion. Then, it is introduced into the back side chamber 44 of the vane 38 of the low stage compression element 7 before it urges the back side of the vane in a state in which the lubricating oil is foamed. Furthermore, it lubricates the sliding surface of the vane 38. The lubricating oil in the back side chamber 44 is discharged into the low stage discharge chamber 45 via the oil returning passage 49*c* and the oil returning hole 49*a* which are always opened. In this state, the oil level always (during both the operation of the compressor and the stoppage of the same) maintains the level at the end portion of the opening in the upper stream from the oil returning passage 49*c*. Therefore, the pressure of the lubricating oil is equal to the pressure in the low stage discharge chamber 45.

In a period from the moment at which the operation of the compressor has been stopped to the moment at which the operation is again started and the lubricating oil pressure in the oil reservoir 35 is supplied to the back side chamber 44 to compensate the pressure difference via the lower stream passage 61*c*, the gas pressure acts on the lubricating oil left in the back side chamber 44 during the stoppage of the operation of the compressor so that the sliding surface of the vane 38 is lubricated.

Since the other operations are the same as those according to the first embodiment, their descriptions are omitted here.

Then, the operation of the third embodiment will now be described with reference to FIGS. 8 and 9.

While following the rotation of the drive shaft 106, the vanes 138 and 139 respectively sliding in the vane grooves 68*a* and 68*b* of the first rotor 107*b* and the second rotor 109*b* rotate while reciprocating in the above- described grooves 68*a* and 68*b*.

When the vanes 138 and 139 perform the reciprocating motions, the vane grooves 68*a* and 68*b* serve as a pump.

Thus lubricating oil having been subjected to the pumping effect enters into the vane grooves 68*a* and 68*b* to urge the vanes 138 and 139 radially outwardly, so that these vanes are caused to bear against the cylinder inner walls, thereby enabling partitioning of the interiors of the cylinders into suction chambers and compression chambers. Thus the refrigerant gas is subjected to actions of suction and compression from the suction chambers and compression chambers thus formed in the cylinders.

Lubricating oil in the oil reservoir 35 on which the discharge pressure acts is reduced in pressure when it passes through the lower stream injection passage 161*a* of the injection passage 161. Then, it is intermittently supplied to the vane groove 68*a* of the first rotor 107*b* and the same sequentially passes through the shaft hole 162 penetrating the drive shaft 106, the radial directional hole 69 and the annular groove 70 before it is always supplied to the vane groove 68*b* of the second rotor 109*b* while maintaining the pressure level.

Lubricating oil in the foam state and containing the refrigerant gas supplied to the vane groove 68*a* of the first rotor 107*b* is intermittently introduced into the low stage discharge chamber 45 via the oil returning holes 149*b* and 49*a*. It is further intermittently pressurized by the pumping effect realized at the time of the reciprocating motion of the vane 138 so as to lubricate the sliding surface of the vane 138.

Since lubricating oil supplied to the vane groove 68*b* of the second rotor 109*b* is always connected to the oil reservoir 35, the degree of being pressurized in a pump manner due to the reciprocating motion of the vane 139 is restricted.

Lubricating oil in the oil reservoir 35 is reduced in pressure when it passes through the upper stream injection passage 161*b* of the injection passage 161. It is then supplied to the cylinder of the high stage compression element 109 to compensate the pressure difference so as to seal the gaps in the compression chamber and to lubricate the sliding surface.

Since the other operations are the same as those according to the first embodiment of the present invention, their descriptions are omitted here.

Then, the operation of the fourth embodiment of the present invention will now be described with reference to FIG. 10.

The refrigerant gas is introduced into the first accumulator 202 when the operation of the two-stage compressor has been commenced. The periodical pulsation of the refrigerant gas is restricted before it is introduced into the low stage compression element 207 via the suction pipe 202*a* so as to be compressed. The compressed refrigerant gas is sequentially supplied to the suction side of the high stage compression element 209. Since the supercharge effect of the first accumulator 202 is restricted, the capacity of the gas introduced into the low compression element 207 per rotation is not considerably changed even if the operation speed of the compressor is changed. Therefore, the low stage discharged gas can be supplied by a substantially constant rate with respect to the cylinder capacity of the high stage compression element 209. As a result, the abnormal rise of the low stage discharged gas can be prevented even if the operation speed of the compressor is changed and thereby a substantially constant pressure can be maintained. Therefore, the supercharge of the low stage compression element in the compressor can be reduced.

The non-evaporated refrigerant introduced from the gas-liquid separator (omitted from illustration) into the second accumulator 202*b* is, together with the low stage discharged gas, introduced into the suction side of the high stage compression element 209 after it has passed through the valve body 206.

On the other hand, the low stage discharge refrigerant does not separate the lubricating oil but is dispersed to include lubricating oil introduced into the adjacent back side chamber 244 from the oil reservoir 35 via the oil introduction passage 261 so as to lubricate the sliding surface of the back side chamber 244 before it is supplied to the high stage compression element 209.

Since the other operations are the same as those according to the first embodiment, their descriptions are omitted here.

As described above, according to the above-described embodiment, the two stage compression mechanism is constituted in such a manner that the electric motor 5 and the two compression elements (the low stage compression element 7 and the high stage compression element 9) arranged to be driven by the electric motor 5 are disposed in the closed container 3 and the above-described two compression elements are sequentially and in series connected. The motor room 8 in the space of the closed container 3 is filled with the discharge pressure from the high stage compression element 9. Lubricating oil present in the oil chamber 35 on which the discharge pressure acts is introduced into the back side chamber of the vane 39 which sections the inside portion of the cylinder of the high stage compression element 9 when it advances/retracts (moves forward/backward) in the cylinder. On the other hand, lubricating oil, on which the pressure discharged from the high stage compression element 9 into the motor room 8 in the closed container 3 acts, is supplied to the back side chamber 44 of the vane 38 which sections the inside portion of the cylinder of the low stage compression element 7 when it advances/retracts (moves forward/backward) in the cylinder via the oil injection passage 61 having throttle portion after the pressure of it has been reduced to the same level as that the pressure discharged from the low stage compression element 8. Furthermore, the vanes 38 and 39 are respectively urged by the pressure of lubricating oil supplied to the back side chambers 44 and 43. As a result, the rolling piston rotary type compressor mechanism is constituted. Therefore, lubricating oil on which the discharge pressure acts can be caused to effect to the back side of the vane 38 of the high stage compression element 9. On the other hand, lubricating oil (including foamed gas separated from lubricating oil at the time of pressure reduction) the pressure of which is equivalent to the pressure in the low stage discharge chamber 45 can be caused to act on the back side of the vane 39 of the low stage compression element 7. As a result, urging force following the pressure in the cylinder of each of the compression elements 7 and 9 can be given to the back side of each of the vanes 38 and 39 of the compression elements 7 and 9. Therefore, the generation of excessively large or insufficient contact pressure in the tip end of each of the vanes 38 and 39 can be prevented. As a result, a contact pressure of a level suitable for sectioning the inside portion of the cylinder into the suction chamber and the compression chamber acts. Therefore, the abnormal wear of the tip end of each of the vanes 38 and 39 can be prevented and as well as the gas leakage during the compression operation can be prevented. Furthermore, the input loss due to the wear can be reduced.

In addition, the jumping phenomenon taken place in the vanes 38 and 39 can be prevented so that the generation of the impact noises between the vanes 38 and 39 can be prevented. Therefore, the durability can be improved and the prevention of noise and vibrations can be realized.

Also according to the above-described embodiment, the opening portion of the oil injection passage 61 having the throttle portion connected to the back side chamber 44 of the vane 38 of the low stage compression element 7 and formed in the back side chamber 44 is arranged to be opened in the sliding surface of the vane 38 so that it is intermittently opened/closed when the vane 38 performs the reciprocating motion. Therefore, when lubricating oil in the oil reservoir 35 on which the discharged pressure from the high stage compression element 9 acts is supplied to the back side chamber 44 of the vane 38 via the oil injection passage 61 having the throttle portion to compensate the pressure difference, it is intermittently stopped at the introduction portion to the back side chamber 44. As a result, resistance due to the introduction of lubricating oil increases in proportion to the operation speed of the compressor. Therefore, the quantity of oil to be supplied to the back side chamber 44 of the vane 38 is decreased to reduce the pressure in the back side chamber of the vane at the time of the high speed operation in which the gas compression time in the cylinder is shortened and the quantity of the gas leakage during the compression operation becomes reduced. As a result, the urging force applied to the vane 38 for sectioning the inside portion of the cylinder into the suction chamber and the discharge chamber can be weakened to reduce the wear at the tip end of the vane and that of the outer surface of the first piston. Therefore, the durability can be improved and as well as the undesirable enlargement of the gap in the low stage side compression chamber can be prevented. As a result, the leakage of the gas during the compression operation can be reduced, the increase in the input can be prevented and the compression efficiency can be improved.

According to the above-described embodiment, the oil injection passage 61 having the throttle portion is provided in the intermediate plate 36 which establishes a connection between the cylinder members (the first cylinder block 7*a* and the second cylinder block 9*a*) of the adjacent low stage compression element 7 and the high stage compression element 9. The above-described oil injection passage 61 is opened in the sliding surface of the intermediate plate 36 which slides on the surface of the vane 38 (the vane 39). Therefore, lubricating oil in the closed container 3 is forcibly supplied to sliding surface between the end surface of the vane 38 (the vane 39) and the intermediate plate 36 via the oil injection passage 61 by utilizing the pressure difference. As a result, the above-described sliding surface can be lubricated, causing the wear to be reduced. In addition, gaps present in the sliding surface can be sealed by oil films so that an excess introduction of lubricating oil in the back side chamber 44 (the back side chamber 43) of the vane 38 (the vane 39) into the cylinder via a portion between the sliding surfaces of the vane end surfaces is prevented. Therefore, the increase in the input due to the contraction of oil can be prevented and as well as the leakage of the compression gas from the cylinder into the suction chamber via the gap formed at the time of the sliding operation between the end surface of the vane and the intermediate plate can be prevented. Consequently, the deterioration in the compression efficiency can be prevented.

According to the above-described embodiment, the oil injection passage 61 having the throttle portion and disposed in the intermediate plate 36 is opened in the upper portion of the back side chamber 44 of the vane 38. Therefore, lubricating oil present in the closed container 3 can be supplied from the upper portion of the back side chamber 44 of the vane 38 via the oil injection passage 61. As a result, even if the quantity of oil supplied is insufficient, lubricating oil can be sequentially supplied to the sliding surface of the vane 38 during the downward movement of the lubricating oil from the upper portion of the back side chamber to the lower portion of the same. Therefore, lubricating oil can be efficiently utilized to lubricate the sliding surface over a wide area and to seal the gap in the sliding surface with oil. Therefore, the durability of the vane sliding portion can be improved and the compression efficiency can be improved.

According to the above-described embodiment, the oil injection passage 61*c* having the throttle portion is provided in the junction surface between the intermediate plate 36, which establishes a connection between the cylinder blocks (the first cylinder block 7*a* and the second cylinder block 9*a*) of the adjacent low stage compression element 7 and the high stage compression element 9, and the first cylinder block 7*a*. Therefore, the oil injection passage 61*c* which has the throttle portion which must achieve a satisfactory accuracy can easily be manufactured at the junction between the intermediate plate and the end surface of the cylinder. As a result, the cost of the elements can be reduced. In addition, lubricating oil can be stably supplied to the back side chamber 44 of the vane to compensate the pressure difference. Therefore, vane back pressure urging force can be uniformly supplied, the gap in the compression chamber can be effectively sealed by oil films and the wear and abrasion can be reduced. As a result, the compression efficiency can be improved and satisfactory reliability can be obtained.

According to the above-described embodiment, the back side chamber 44 of the vane 38 of the low stage compression element 38 is connected to the low stage discharge chamber 45. Therefore, lubricating oil present in the sealed container 3 on which the high stage discharge pressure acts can be reduced in pressure when it passes through the oil injection passage before it is, together with the low stage discharge gas, introduced into the cylinder of the high stage discharge element 9 via the back side chamber 44 of the vane 38 of the low stage compression element 7 and the low stage discharge chamber 45. As a result, proper back pressure urging force of the same level as the low stage discharge pressure can be given to the vane 38 in the back side chamber 44 of the vane 38 place at the intermediate position of the above described route. Furthermore, the sliding surface can be lubricated. In addition, in the cylinder of the high stage compression element 9, each sliding surface can be lubricated by the oil film, the impact noise generated between the second piston 9*b* and the tip end of the vane 39 can be eliminated and the gap in the compression chamber can be sealed with the oil films. Therefore, the leakage of the refrigerant gas during the compression operation can be prevented. As a result, the durability of the sliding surface can be improved, the compression efficiency of the high stage compression element 9 can be improved and the noises can be eliminated.

After the operation of the compressor has been stopped, oil is supplied by utilizing the residual pressure difference so that lubricating oil present in the oil reservoir 35 is accumulated in the low stage discharge chamber 45 so as to prepare for the supply of oil to the back pressure chamber 44 at the time of restarting the operation of the compressor.

According to the above-described embodiment, the position at which the oil returning passage 49, which passes from the low stage discharge chamber 45 of the low stage compression element 7 to the back side chamber 44 of the vane 38, is opened in the upper portion of the back side chamber 44. As a result, undesirable introduction of the overall quantity of lubricating oil present in the closed container 3 and supplied to the back side chamber 44 of the vane 38 via the oil injection passage 61*c* into the low stage discharge chamber 45 via the oil returning passage 49 during the operation and stoppage of the same of the compressor can be prevented. Therefore, a predetermined quantity of lubricating oil can always can be secured. As a result, one vane sliding surface can be lubricated and as well as the sliding gap can be sealed with the oil films. Therefore, the durability of the vane sliding surface can be improved and undesirable introduction of lubricating oil in the back side chamber 44 and that of the refrigerant gas into the cylinder via the gap in the vane can be prevented. Therefore, the input loss can be prevented.

According to the above-described embodiment, the low stage compression element 7 opened in the low stage discharge chamber 45 of the back side chamber 44 of the vane is arranged to be the bottom portion of the discharge chamber oil reservoir 46 of the low stage discharge chamber 45. Therefore, even if the pressure in the closed container 3 and the temperature of lubricating oil are insufficiently high as is observed at the initial stage of the cold starting the compressor and thereby satisfactory oil supply to the back side chamber 44 of the vane 38 via the oil injection passage 61 having the throttle passage cannot be expected, lubricating oil accumulated in the bottom portion of the discharge chamber oil reservoir 46 of the low stage compression element 7 can be inversely supplied to the back side chamber 44 of the vane 38 via the oil returning passage 49. Therefore, the oil can be sequentially supplied to the gap in the sliding portion of the vane 38 and the suction chamber in the cylinder to compensate the pressure difference. In addition, the pressure discharged from the low stage compression element 7 is caused to act on the back side of the vane 38 from the initial stage of the commencement of the operation of the compressor. Therefore, a proper contact pressure can be given to the tip end of the vane 38. As a result, the vane 38 is able to always section the inside portion of the cylinder into the suction chamber and the compression chamber to seal the compression chamber while preventing the generation of jumping of the first piston 7*b* from the early stage of the commencement of the operation of the compressor. Furthermore, impact noises which could be generated between the vane 38 and the first piston 7*b* can be eliminated. Therefore, the durability of the vane 38 and that of the first piston 7*b* can be improved, the noises can be eliminated and the compression efficiency can be improved at the early stage of the commencement of the operation of the compressor.

According to the above-described embodiment, the partition plate 48 is disposed in the upper portion of the discharge chamber oil reservoir 46 in the bottom portion of the low stage discharge chamber. Furthermore, a plurality of the apertures 47 establishing a connection between the upper space in the low stage discharge chamber 45 and the discharge chamber oil reservoir 46 are formed in the partition plate 48. Therefore, when lubricating oil accumulated in the bottom portion of the discharge chamber oil reservoir 46 is dispersed by the flow of the gas discharged from the cylinder of the low stage compression element into the low stage discharge chamber 45, the introduction of the discharge gas into the discharge chamber oil reservoir 46 can be absorbed by the partition plate 48 disposed in the upper portion of the discharge chamber oil reservoir 46. As a result, undesirable introduction of lubricating oil in the discharge chamber oil reservoir 46 into the suction side of the high stage compression element 9 together with the discharge gas can be prevented. Therefore, lubricating oil can always be secured in the discharge chamber oil reservoir 46. Furthermore, the introduction of the discharge gas into the back side chamber 44 of the vane 38 via the oil returning passage 49 can be prevented. Therefore, lubricating oil in the back side chamber 44 can always be secured to seal the gap in the sliding portion of the back side chamber 44 with the oil film. As a result, the undesirable inverse introduction of the discharge gas into the cylinder via the back side chamber 44 of the vane 38 can be prevented. Therefore, the deterioration in the compression efficiency can be prevented and the durability of the vane sliding surface can be improved.

Although the description is made about the two stage compressor according to the aforesaid embodiment, a similar effect and operation can be obtained from a three or more stage compressor by applying and developing the structure according to the above-described embodiment.

Although lubricating oil on which the high stage discharge gas pressure acts is accumulated in the closed container according to the above-described embodiment, another oil supply passage may be structured which is arranged in such a manner that lubricating oil is accumulated in an oil separating device on the discharge side provided outside the compressor and lubricating oil is introduced into the compressor.

Although the structure according to each of the above- described embodiments is arranged in such a manner that the low stage compression element is disposed in the lower portion and the high stage compression element is disposed in the upper portion, another structure may be employed in which the high stage compression element is disposed in the lower portion and the low stage compression element is disposed in the upper portion. As an alternative to this, they may be disposed horizontally.

Although the description is made about the refrigerant compressor according to the above-described embodiments, a similar operation and effect can be obtained from a multi-stage gas compressor which compresses another gas (for example, oxygen, nitrogen, herium, air or the like).

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A rolling piston type or slide vane rotary type multi-stage gas compressor comprising:

a multi-stage compression mechanism comprising a plurality of compression elements connected in series, one of said plurality of compression elements being a final stage compression element and all other of said plurality of compression elements being non-final stage compression elements, each of said plurality of compression elements comprising (a) a cylinder having a hollow inside portion, (b) a back side chamber in communication with said inside portion, (c) a piston disposed in said inside portion, and (d) a vane mounted to undergo reciprocating motion and extending partly into said back side chamber and partly into said inside portion of said cylinder and cooperating with said piston and said cylinder so as to section the inside portion of the cylinder into a suction chamber and a compression chamber; and oil supply passage means for (i) introducing lubricating oil on which discharge pressure acts into said back side chamber of said final stage compression element and for (ii) introducing said lubricating oil into the back side chamber of each of said non-final stage compression elements after a pressure of said lubricating oil has been reduced to a level equivalent to the discharge pressure from each of said compression elements, said oil supply passage means being arranged to pass via said back side chamber of each of said plurality of compression elements, whereby said lubricating oil applies pressure onto a back side of each of said vanes.

2. A rolling piston type or slide vane rotary type multi-stage gas compressor according to claim 1, further comprising an electric motor for driving said plurality of compression elements and a closed container for accumulating said lubricating oil on which a discharge pressure from said final stage compression element acts and for enclosing said plurality of compression elements and said electric motor, a compressed gas being discharged from said final stage compression element into said closed container.

3. A rolling piston type or slide vane rotary type multi-stage gas compressor according to claim 2, wherein each of said compression elements further comprises a sliding surface on which said vane slides and wherein said oil supply passage means comprises an opening portion formed in said sliding surface to provide a throttle portion in said back side chamber, said opening portion being intermittently opened and closed when said vane undergoes said reciprocating motion.

4. A rolling piston type or slide vane rotary type multi- stage gas compressor according to claim 2, wherein an oil supply passage which passes via an intermediate plate which establishes a connection between cylinder members of adjacent compression elements is provided, said oil supply passage being opened in the sliding surface of said intermediate plate which slides on a surface of said vane.

5. A rolling piston type or slide vane rotary type multi-stage gas compressor according to claim 2, wherein said oil supply passage means comprises a throttle portion and is opened in an upper portion of said back side chamber or at least one of said plurality of compression elements.

6. A rolling piston type or slide vane rotary type multi-stage gas compressor according to claim 2, further comprising an intermediate plate that establishes a connection between said cylinders of adjacent ones of said plurality of compression elements, said intermediate plate forming conjunction surfaces between itself and said cylinders of said adjacent ones of said plurality of compression elements, and wherein said oil supply passage means comprises a throttle portion formed in one of said conjunction surfaces.

7. A rolling piston type or slide vane rotary type multi-stage gas compressor according to claim 2, wherein said multi-stage compression mechanism constitutes a two stage compression mechanism in which said non-final stage compression elements are constituted of a low stage side compression element and in which said said final stage compression element is constituted of a high stage compression element, and wherein said oil supply passage means comprises a discharge chamber affixed to said low stage compression element so as to be disposed in a lower stream of said back side chamber of said low stage compression element.

8. A rolling piston type or slide vane rotary type multi-stage gas compressor according to claim 7, wherein said oil supply passage means comprises a connecting passage arranged from said discharge chamber to said back side chamber of said low stage compression element and wherein said connecting passage has an opening in an upper portion of said back side chamber of said low stage compression element.

9. A rolling piston type or slide vane rotary type multi-stage gas compressor according to claim 7, wherein said discharge chamber comprises an oil reservoir and wherein said oil supply passage means comprises an opening in said discharge chamber formed in a bottom portion of said oil reservoir of said discharge chamber.

10. A rolling piston type or slide vane rotary type multi-stage gas compressor according to claim 9, further comprising a partition plate disposed in an upper portion of said oil reservoir and wherein said partition plate comprises a small-diameter passage for establishing a connection between an upper space of said discharge chamber and said oil reservoir chamber.

11. A rolling piston type or slide vane rotary type multi-stage gas compressor according to claim 1, wherein said back side chamber is formed in said cylinder.

12. A rolling piston type or slide vane rotary type multi-stage gas compressor according to claim 1, wherein said back side chamber is formed in said piston.

13. A rolling piston type or slide vane rotary type multi-stage gas compressor according to claim 1, wherein at least one of said plurality of compression elements comprises a plurality of back side chambers and a plurality of vanes in one-to-one correspondence with said plurality of back side chambers, each of said plurality of vanes extending partly into said inner portion and partly into a corresponding one of said plurality of back side chambers, and wherein said oil supply passage means introduces oil into each of said plurality of back side chambers.

* * * * *